US007017212B2

(12) United States Patent
Matthews Brown

(10) Patent No.: US 7,017,212 B2
(45) Date of Patent: Mar. 28, 2006

(54) SUPPORT PILLOW WITH FLAPS AND METHODS

(75) Inventor: Susan H. Matthews Brown, Evergreen, CO (US)

(73) Assignee: The Boppy Company, Golden, CO (US)

( * ) Notice: Subject to any disclaimer, the term of this patent is extended or adjusted under 35 U.S.C. 154(b) by 207 days.

(21) Appl. No.: 10/618,432

(22) Filed: Jul. 10, 2003

(65) Prior Publication Data

US 2004/0060116 A1 Apr. 1, 2004

Related U.S. Application Data

(63) Continuation-in-part of application No. 10/460,508, filed on Jun. 11, 2003, which is a continuation of application No. 09/884,742, filed on Jun. 18, 2001, now Pat. No. 6,640,977, which is a continuation-in-part of application No. 09/537,949, filed on Mar. 28, 2000, now Pat. No. 6,685,024, which is a division of application No. 09/265,163, filed on Mar. 9, 1999, now Pat. No. 6,055,687, which is a division of application No. 09/831,803, filed on Apr. 9, 1997, now abandoned, which is a continuation-in-part of application No. 08/590,653, filed on Jan. 24, 1996, now Pat. No. 5,661,861, said application No. 10/618,432, is a continuation-in-part of application No. 10/046,377, filed on Oct. 26, 2001, now Pat. No. 6,671,908.

(51) Int. Cl.
*A47G 9/00* (2006.01)

(52) U.S. Cl. ..... 5/630; 5/652; 5/655; 297/393

(58) Field of Classification Search ..... 5/636, 5/655, 630, 646, 654, 653, 643, 640, 490, 5/652; D6/601; 297/393
See application file for complete search history.

(56) References Cited

U.S. PATENT DOCUMENTS

| | | | | |
|---|---|---|---|---|
| 255,966 | A | * 4/1882 | Gayman | 417/434 |
| 682,871 | A | 9/1901 | Hogan et al. | |
| 1,251,461 | A | 1/1918 | Bachmann | |
| 1,343,357 | A | 6/1920 | Eggers | |
| 2,328,871 | A | 9/1943 | Woehler | |
| D160,223 | S | 9/1950 | Smith | |
| 2,690,253 | A | 9/1954 | Francois | |
| 2,961,668 | A | 11/1960 | Hayes | |
| 2,995,845 | A | 8/1961 | Fraser | |
| 3,796,304 | A | 3/1974 | Blais | |
| 3,842,977 | A | 10/1974 | Hollander | |
| 3,848,281 | A | 11/1974 | Mathews | |
| 3,872,968 | A | 3/1975 | Hawkins et al. | |
| 3,911,512 | A | * 10/1975 | Plate | 5/652 |
| 3,920,239 | A | 11/1975 | White | |
| 4,000,768 | A | 1/1977 | Siegel | |
| 4,161,794 | A | 7/1979 | Darnfors | |
| 4,197,604 | A | 4/1980 | Nakamura | |
| D255,966 | S | 7/1980 | Stadel | |
| 4,219,140 | A | 8/1980 | Simonoff | |

(Continued)

FOREIGN PATENT DOCUMENTS

| | | |
|---|---|---|
| EP | 1 306 034 A1 | 5/2003 |
| FR | 2 379 268 | 9/1978 |
| FR | 1.430.355 | 1/1986 |
| GB | 215846 | 5/1924 |
| GB | 1 508 809 | 4/1978 |
| GB | 2 198 341 A | 6/1988 |
| WO | WO 02/21978 A2 | 3/2002 |
| WO | WO 02/21979 A1 | 3/2002 |
| WO | WO 02/28232 A1 | 4/2002 |

*Primary Examiner*—Alexander Grosz
(74) *Attorney, Agent, or Firm*—Townsend and Townsend and Crew LLP

(57) ABSTRACT

A support pillow comprises a pillow body having a medial region and two opposing arms a pillow body having a medial region and two opposing arms that define an outer periphery and an inner periphery, wherein the inner periphery defines a generally open well. At least one flap is coupled to the pillow body at the outer periphery to adjust the position of the pillow when worn about a user.

20 Claims, 14 Drawing Sheets

U.S. PATENT DOCUMENTS 4,236,264 A 12/1980 Britzman
4,257,522 A 3/1981 Thorneburg
4,345,347 A 8/1982 Kantor
4,601,417 A 7/1986 Kunreuther
4,731,890 A 3/1988 Roberts
4,803,852 A 2/1989 Waldron
4,858,259 A * 8/1989 Simmons et al. ..... 5/644
4,889,512 A 12/1989 Burnett et al.
4,959,879 A 10/1990 Marxhausen
5,029,350 A 7/1991 Edelson
5,056,533 A 10/1991 Solano
5,119,940 A 6/1992 Grindrod
5,134,740 A 8/1992 Summer
5,154,649 A 10/1992 Pender
5,193,235 A 3/1993 Kircher
5,257,429 A * 11/1993 Genis ..... 5/636
5,261,134 A 11/1993 Matthews
5,313,678 A 5/1994 Redewill
D348,174 S 6/1994 Genis
D352,633 S 11/1994 Berggren
5,390,794 A 2/1995 Vulpitta
D360,554 S 7/1995 Righini
5,519,906 A 5/1996 Fanto-Chan
5,546,620 A * 8/1996 Matthews ..... 5/655
5,572,753 A 11/1996 Ruscitto
5,581,833 A 12/1996 Zenoff
D377,881 S 2/1997 Watt
5,626,268 A 5/1997 Kolton et al.
5,661,861 A 9/1997 Matthews
5,664,828 A * 9/1997 Simon ..... 297/153
5,702,153 A 12/1997 Pliska
5,775,504 A 7/1998 Menaged
5,790,999 A 8/1998 Clark
5,868,430 A 2/1999 Kolosvary
5,888,565 A 3/1999 Gics
5,900,263 A 5/1999 Gics
5,958,484 A 9/1999 Gics
6,038,720 A * 3/2000 Matthews et al. ..... 5/639
6,052,848 A 4/2000 Kelly
6,055,687 A 5/2000 Matthews
6,073,758 A 6/2000 Webster et al.
6,161,959 A 12/2000 Abraham
6,216,298 B1 * 4/2001 Oliveira ..... 5/636
6,233,767 B1 5/2001 Horowitz
6,279,185 B1 8/2001 Matthews
6,321,403 B1 11/2001 Matthews
6,354,665 B1 3/2002 Ross
6,394,337 B1 5/2002 Ross et al.
6,412,128 B1 7/2002 Matthews
6,434,770 B1 * 8/2002 Matthews Brown ..... 5/636
6,453,493 B1 9/2002 Matthews Brown
6,487,737 B1 12/2002 Futagami
6,523,200 B1 2/2003 Brown
6,532,612 B1 3/2003 Matthews Brown
6,625,828 B1 9/2003 Matthews Brown
2001/0037957 A1 * 11/2001 Matthews Brown ..... 206/461
2002/0014436 A1 2/2002 Matthews Brown

* cited by examiner

Fig. 12
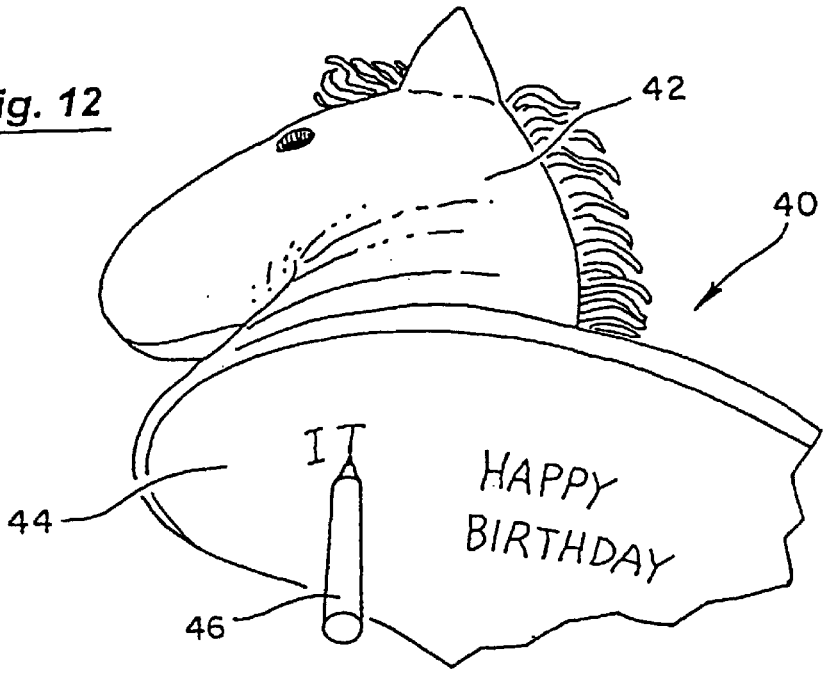
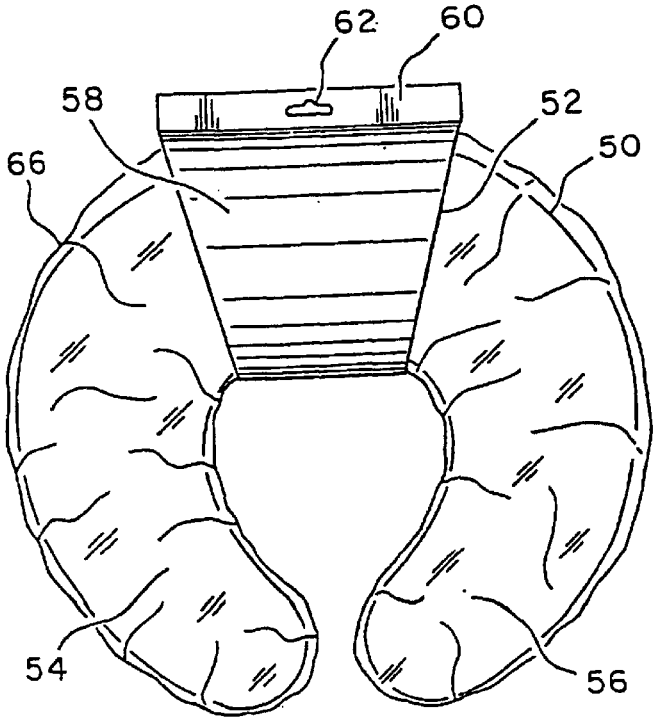
Fig. 13
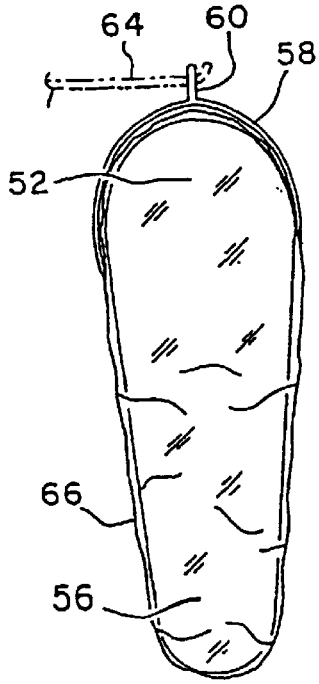
Fig. 14

SUPPORT PILLOW WITH FLAPS AND METHODS

CROSS-REFERENCES TO RELATED APPLICATIONS

This application is a continuation in part application of U.S. application Ser. No. 10/460,508, filed Jun. 11, 2003 , which is a continuation application of U.S. application Ser. No. 09/884,742, filed June 18, 2001 (now U.S. Pat. No. 6,640,977), which is continuation in part application of U.S. application Ser. No. 09/537,949, filed Mar. 28, 2000 (now 6,685.024) which is a divisional application of U.S. application Ser. No. 09/265,163 (U.S. Pat. No. 6,055,687), which is a divisional application of U.S. application Ser. No. 08/831,803, filed Apr. 9,1997 (abandoned), which is a continuation-in-part application of U.S. application No. 08/590,653, filed Jan. 24, 1996 (U.S. Pat. No. 5,661,861); and is a continuation is part of U.S. application Ser. No. 10/046,377, filed Oct. 26, 2001 (now 6,671,908), the complete disclosures of which are herein incorporated by reference.

BACKGROUND OF THE INVENTION

The present invention relates generally to the field of therapeutic support pillows, and in particular to support pillows and methods for their use which are intended as improvements to the support pillow and methods described in U.S. Pat. No. 5,261,134, the complete disclosure of which is herein incorporated by reference.

U.S. Pat. No. 5,261,134 describes a therapeutic support pillow which is provided to support a small child or an infant, and particularly to hold a small child in a manner that prohibits lateral movement. Although the support pillow described in U.S. Pat. No. 5,261,134 has been generally successful when used to prohibit the lateral movement of a small child, various improvements are desired. For example, it would be desirable if such a support pillow could be used with an adolescent or an adult. For some applications, it would be further desirable if improvements could be made to the overall structure of the support pillow.

Many adults or adolescents participate in activities which make it desirable to support certain objects or body parts. For example, with activities such as reading, typing, breast feeding, and the like, it is often desirable to support the arms or elbows. As another example, when sleeping in an upright position it is often desirable to have the neck and head supported. As a further example, it is often desirable to provide support to the lower back.

Although some support structures have been proposed for supporting objects or body parts, such as the arms of a chair or certain braces, such structures are often uncomfortable and inconvenient to use. Further, some support structures are not easily portable, thereby limiting their use. In a further drawback, most support structures are designed only for a particular application and do not have multiple uses.

For these and other reasons, it would be desirable to provide an improved support pillow and methods which would overcome these and other drawbacks. In particular, it would be desirable if such a support structure and methods were capable of supporting certain small objects or body parts, such as the arms, elbows, lower back, neck or head. Such a support pillow and methods should be comfortable, portable, and easy to use. In one particular aspect, it would be desirable if such a support pillow could be used in a variety of applications to support certain objects or body parts.

BRIEF SUMMARY OF THE INVENTION

The invention provides a support pillow and methods for its use. In one exemplary method, support is provided to a person's lower back. According to this method, a support pillow is provided having a resilient cushion body with a medial region and first and second opposing cantilever arms extending from the medial region. The cantilever arms have respective first and second end portions remote from the medial region. The cantilever arms are curved about a vertical access to define a substantially toroidal configuration for the cushion body and to position the first and second end portions in a confronting relation to one another. The cantilever arms and medial region cooperate to define a generally circular open well. Such a support pillow is placed around the person's torso in the area of the lower back. The first and second end portions of the cantilever arms are positioned in front of the person's torso, and the medial region of the support pillow is positioned adjacent the person's lower back. The cantilever arms are biased around the person's torso to hold the support pillow vertically positioned relative to the person's torso while the medial region is positioned against the person's lower back. In this manner, the support pillow may be employed to support the person's lower back even when the person is in various positions. For example, the support pillow may be used to support the lower back when the person is sitting in an upright position, such as when sitting in a chair. Alternatively, the support pillow may provide support to the person's lower back while the person is lying.

In one particular aspect, the support pillow is removably held within a flexible container having a bottom end, at least one side and an open top. A base member is held within the bottom end of the container. With this configuration, the base member holds the container in a vertical orientation when the bottom end rests upon a surface, thereby providing a convenient way to store the support pillow. To use the support pillow, the user simply removes the support pillow from the container and then places the pillow around the torso. Preferably, the container comprises a clear plastic or polymer and the base member is constructed of a paper material. Optionally, the top end may be provided with a fastener, such as a zipper, a snapable handle, or the like which provides a way to both carry the pillow and to close the top end of the container.

In one particular configuration, the base member comprises a bottom and two spaced apart walls extending from the bottom. In this way, the pillow may rest on the bottom while being held between the two walls. Further the container may comprise a transparent cover that covers the pillow and the base member. In one aspect, the walls may be triangular in geometry and may extend fully or only part way along the pillow. For example, the walls may angle to a point that is adjacent the medial region of the pillow.

Conveniently, the medial region may rest on the bottom of the base member. Alternatively, the ends of the arms may rest on the bottom of the base member. The base member may be configured to hold support pillows having a variety of sizes. In one particular configuration, the bottom of the base member may have a width in the range from about 1 inch to about 10 inches, more preferably from about 2 inch to about 6 inches, and still more preferably from about 2.5 inches to about 5 inches. Further, the walls may be parallel to the bottom to assist in holding the pillow in an upright orientation. In another configuration, the top end of the cover may be curved to match a curved outer perimeter of the pillow.

In still another configuration, the cover may used to hold various other items in addition to the pillow. For example, the pillow may be used in combination with one or more bars from which toys may be suspended. These bars, and any toys, may also be held within the cover. In one particular arrangement, the bars are curved and around a curved outer perimeter of the pillow. Further, the top end of the cover may be curved and be adjacent to the curved bar. As another example, the pillow may have a pad that is coupled to the pillow body. During storage, the pad is folded against the pillow body and inserted between the walls of the base member. Moreover, it will be appreciated that other configurations of support pillows may be held between the walls of such a base member.

In a further configuration, the base member may also include a top that is coupled to the two walls. In this way, the walls, the bottom and the top of the base member may be disposed around the medial region of the pillow.

In another exemplary method, such a support pillow may be placed around the person's torso, with the first and second end portions of the cantilever arms being at the back of the person's torso, and with the medial region of the support pillow being adjacent the front of the person's torso. The cantilever arms are biased around the person's torso to hold the support pillow vertically positioned relative to the person's torso. With the support pillow placed around the person's torso in this manner, an object may be rested on the cantilever arms or the medial region while the cantilever arms are biased around the person's torso.

For example, the person may be sitting while resting the object on the cantilever arms. In one exemplary aspect, the object is printed material, such as a book, that is rested on the medial region. Alternatively, other objects such as games, food, video game controls, and the like, may be rested on the medial region. In a further aspect, the person's elbows or forearms are rested on the medial region. Resting of the person's forearms or elbows in this manner is advantageous when performing a variety of activities with the hands, such as typing on a keyboard, breast feeding a baby, and the like.

In yet another exemplary method, such a support pillow is provided to support a person's neck and head. According to the method, the support pillow is placed around the person's neck with the first and second end portions of the cantilever arms being at the front of the person's neck. The medial region of the support pillow is positioned adjacent the back of the person's neck. The cantilever arms extend around the person's neck so that the neck is supported at least in part by the cantilever arms in the medial region.

In one aspect, the support pillow is positioned so that the cantilever arms rest on the person's shoulders. In another aspect, the person's head is tilted so as to rest the person's neck and head against the support pillow in the region of the open well. For example, the support pillow may be employed to support the person's neck and head while sitting in a chair or other location where the person's head may be supported when titled. Alternatively, the support pillow may be employed to support the person's neck while lying down.

The invention provides an exemplary support pillow having a resilient cushion body, a medial region and first and second opposing cantilever arms extending from the medial region. The cantilever arms have respective first and second end portions remote from the medial region. The cantilever arms are curved about a vertical axis to define a substantially toroidal configuration for the cushion body and to position the first and second end portions in a confronting relation to one another. The cantilever arms and medial region cooperate to define a generally circular open well. At least a portion of the cushion body is covered with a material suitable for receiving a marking substance from a writing instrument such as a pen, marker, or the like. Preferably, such a material comprises a fabric having a smooth surface (such as satin, rip-stop nylon, and the like) and covers a bottom portion of the cushion body. In this way, the support pillow may be employed to receive an autograph or other message by simply turning the support pillow on its side or top and writing on the bottom portion.

In a preferable aspect, a head member is further provided and is attached to the cushion body. The head member will preferably be attached to one of the cantilever arms such that the head member extends in a direction generally parallel to the vertical axis. In one particular aspect, the head member is in the shape of a unicorn.

The invention provides one particularly preferable embodiment of a support pillow which may be used in a liquid medium, such as water. The support pillow comprises a resilient cushion body having a medial region and first and second opposing cantilever arms extending from the medial region. The cantilever arms have respective first and second end portions remote from the medial region, with the cantilever arms being curved about a vertical axis to define a substantially toroidal configuration for the cushion body and to position the first and second end portions in a confronting relation to one another. The cantilever arms and medial region cooperate to define a generally circular open well. The cushion body is constructed of a sponge material so that the cushion body may be placed in a liquid medium. In this way, the support pillow may be placed around the torso of a person when bathing, with the support pillow maintaining the person in a generally upright position. Alternatively, the support pillow may be placed on the bottom of the bath tub, with the person's head being supported by the medial region.

The invention still further provides a support pillow which conveniently may be provided in kit form. The pillow comprises a pillow body having a medial region and a pair of opposing arms. Further, a central holder is removably secured to the medial region of the pillow body to provide a convenient way to carry and store the support pillow.

In one particular aspect, the central holder comprises a piece of material, such as a paper product, which encircles the medial region. Preferably, the holder includes at least one aperture which is adapted to receive a hanger to hang the support pillow, thereby providing a convenient way to both store and display the support pillow. Optionally, a protective cover, such as a plastic, may be provided to encompass the support pillow.

The invention further provides an exemplary method for storing a support pillow having two opposing arms and a medial region. According to the method, a central holder is placed around the medial region and a hanger is introduced through the central holder to allow the support pillow to hang from the hanger. In this way, the hanger may be employed to conveniently store and display the support pillow. For example, the support pillow may be display along a store aisle to allow a purchaser to easily visualize the support pillow and then remove the support pillow from hanger for purchase.

In a further exemplary embodiment, a support pillow is provided comprising a resilient cushion body and at least one strap which is attached to the cushion body. The strap is configured to attach an article, such as a child's toy, to the cushion body.

In a preferable aspect, the pillow includes two or more straps so that a variety of toys may be attached to the pillow. Further, the pillow will preferably be fashioned to include a medial region and first and second arms extending from the medial region to define a generally circular open well. With this arrangement, the straps are attached to the medial region so that a child may lay on the pillow, with the stomach being over the well, and play with the toys that are attached to the pillow. The straps are therefore advantageous in that they hold the toys close to the pillow so that the child will not push the toys out of reach during play.

The straps may be configured in a variety of ways to hold the toys to the pillow. For example, the toys could be tied to the pillow with the straps. Preferably, each strap will include a fastener which allows the strap to be formed into a loop to secure the article. For instance, each strap may be provided with a hook and loop fastener. In this way, the toys will be removably attached to the pillow to allow for convenient removal and replacement of the toys.

In a further embodiment, the invention provides a support pillow that is constructed of a resilient pillow body having a medial region and two opposing arms extending from the medial region to form a generally open well. The pillow body further includes an outer periphery and an inner periphery adjacent the well. A handle is coupled to the medial region at the outer periphery to provide a convenient way to move and transport the pillow.

In one aspect, the handle comprises an elongate member having a pair of ends that are attached to the medial region to form an opening between the handle and the medial region. The distance across the opening measured perpendicular to the medial region may be about 1 inch to about 4 inches. In this way, a user's fingers may be slipped between the medial region and the handle when grasping the handle. When lifted, the arms hang vertically below the handle.

The pillow body may be constructed in a manner similar to any of the embodiments described or incorporated herein, and the pillow may be used in a manner similar to any of the embodiments described or incorporated herein. In the event that the pillow body includes a fabric cover, the handle ends may conveniently be sewn to the fabric cover. In one aspect, the elongate member may be constructed of a resilient material.

The pillows of the invention may also include one or more flaps at the outer periphery of the pillow body. These flaps may be grasped to permit the position of the pillow to be easily adjusted when worn by the user. For example, when sitting down with the pillow about the torso, one of the flaps may be grasped to rotate the pillow about the person's torso to the desired position.

In one aspect, the flap may be constructed of a piece of fabric that is coupled to the pillow body. Conveniently, the flap may be coupled to the fabric cover, such as by sewing it between seams of the cover. The flaps may be positioned anywhere along the outer periphery, with one position being where the arms meet the medial region. As one specific example, the flaps may be positioned about 12 to about 20 inches apart. The flaps may extend from the pillow body by a distance of about 1 inch to about 6 inches.

BRIEF DESCRIPTION OF THE DRAWINGS

FIG. 12 illustrates a bottom portion of the support pillow of FIG. 9 which is constructed of a material suitable for receiving a marking substance from a writing instrument according to the present invention.

FIG. 13 is a front view of a support pillow having a central holder to allow the support pillow to be conveniently hung and displayed according to the invention.

FIG. 14 is a side view of the support pillow of FIG. 13.

DESCRIPTION OF THE SPECIFIC EMBODIMENTS

Figure 1:
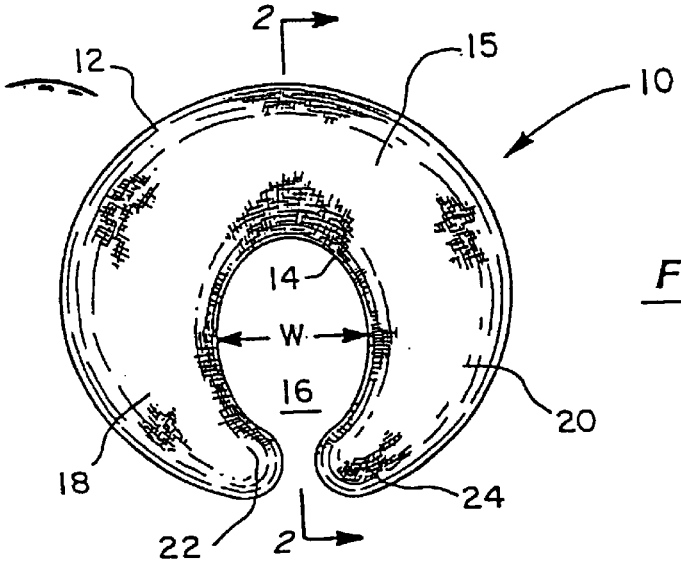
FIG. 1 is a top view of a support pillow constructed in accordance with the present invention.

Referring to FIG. 1, an exemplary embodiment of a support pillow 10 will be described. The support pillow 10 may be constructed similar to the support pillow described in U.S. Pat. No. 5,261,134, as well as in 5,661,861; 6,038,720; 6,055,687; 6,434,770; 6,352,612; 6,279,185; 6,412,128; 6,453,493; and 6,523,200; and in copending U.S. application Ser. No. 10/046,377, filed Oct. 26, 2001 (now U.S. Pat. No. 6,671,908), Ser. No. 09,884,742, filed Jun. 18, 2001 (now U.S. Pat. No. 6,640,977), Ser. No. 09/679,139, filed Oct. 3, 2000, Ser. No. 09/802,097, filed Mar. 8, 2001, 10/426,067, filed Apr. 28, 2003 (now U.S. Pat. No. 6763539); and Ser. No. 10/612266, filed on Jul. 1, 2003, and Ser. No. 10/612267, filed on Jul. 1, 2003 now U.S. Pat. No. 6,857,150. The complete disclosures of all these references are incorporated herein by reference. The support pillow 10 includes a curved outer surface 12 that is rounded in both a longitudinal and a lateral direction. The support pillow 10 further includes a curved central inner surface 14 that defines a rounded, generally circular or elliptical well region 16. While the body of the support pillow 10 is substantially continuous and uniform, with curved surfaces 12 and 14 also being continuous, it is convenient to consider the pillow body as consisting of a medial region 15, and two opposed cantilever arms 18 and 20. The anus 18, 20 extend in opposite directions away from the medial region 15, but are curved towards one another to give the pillow 10 its toroidal configuration. While the continuous structure does not provide a precise or exact division between the medial region 15 and each arm, considering the body of the pillow in view of these components facilitates a description of the structure and function of the pillow 10.

Cantilever arms 18, 20 include respective blunt ends 20 and 24, positioned remotely of the remedial region. The support pillow 10 is proportioned so that ends 22, 24 normally, i.e., when not under external stress, touch one another. However, the ends 22, 24 do not exert substantial pressure against each other. The toroidal shape defined by the outer and inner curved surfaces 12, 14 is proportioned such that at a central vertical plane, represented by line 2—2 in FIG. 1, bisects the pillow 10 at the medial region 15. Pillow 10 thus has bilateral symmetry with respect to the central plane. The central plane further contains a vertical, central axis about which the toroidal pillow body is formed. Profiles of the pillow 10 taken radially of the central axis, i.e., sections of the pillow 10 in planes that also contain the central axis, are elliptical in shape throughout the medial region, and likewise are elliptical throughout the length of each cantilever arm 18, 20 with the exception of blunt ends 22, 24.

Well region 16 has a width W in the direction perpendicular to the central plane. The width W will preferably be in the range from about four to about twelve inches, and more preferably from about four to about eight inches, with a particularly preferred width being about 5.5 inches to about 6.5 inches. Such a width will enable the support pillow to fit "snug" around the torso or waist of most users. The pillow preferably has a circumference of about 15 to 65 inches, and more preferably about 20 inches to about 45 inches. As will be described in greater detail hereinafter, the pillow 10 is constructed so that the arms 18, 20 may be moved away from each other to vary the width W so that the pillow 10 may be used in a variety of applications. Further, the vertical height of the medial region (when the pillow is lying flat) may be in the range from about 4 inches to about 10 inches, and more preferably from about 4 inches to about 5.5 inches. The height of the arms at their ends may be in the range from about 1 inch to about 6 inches, and more preferably from about 2 inches to about 4 inches. The horizontal thickness of the arms and medial region (when the pillow is lying flat) may be in the range from about 4 inches to about 10 inches, and more preferably from about 4 inches to about 8 inches. However, it will be appreciated that the invention is not intended to be limited to only these dimensions.

Figure 2:
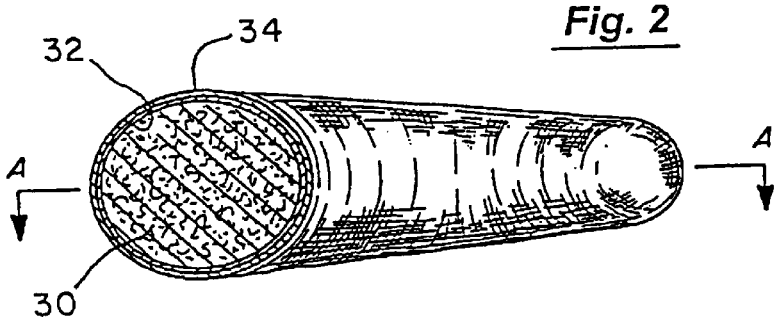
FIG. 2 is a cross-sectional side view of the support pillow of FIG. 1 taken along lines 2—2.

Referring to FIG. 2, the pillow 10 includes a central core 30 which is constructed of a resilient, compression resistant, hypoallergenic material, such as a polyester filling. The central core 30 is encased in a lining 32, such as cotton or other pliant conforming fabric. The polyester is firmly and tightly packed into lining 32, such that the core 30 and lining 32 together provide a self-supporting pillow body, i.e., the support pillow 10 retains its shape without any sagging or drooping of the cantilever arms 18, 20 when held at the medial region 15. The tightly packed polyester core 30 also provides the pillow with firmness in the sense that it will undergo only slight elastic deformation (as compared to a conventional pillow) when an object (such as a persons' arms or elbows) is rested on the arms 18, 20 or medial region. Covering the lining 32 is a conforming, removable exterior covering 34, also preferably constructed of cotton. The elliptical profile i.e., the profile in the central plane, preferably has a vertical height of about four to eight inches, and preferably at about six inches. Line A—A in FIG. 2 represents a horizontal mid-plane, with the top and bottom halves of pillow 10 being symmetrical about the mid-plane.

Figure 3:
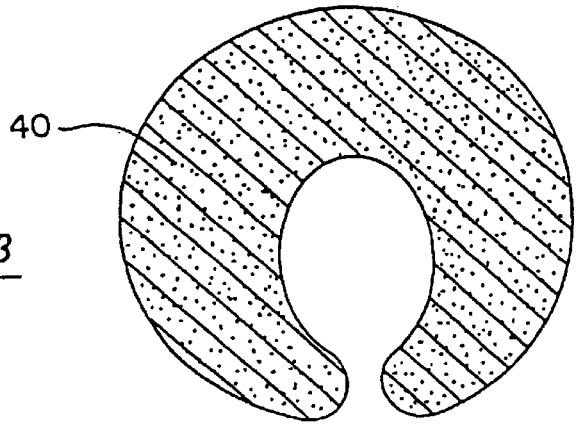
FIG. 3 is a cross-sectional top view of an alternative embodiment of a support pillow according to the present invention.

FIG. 3 illustrates an alternative embodiment of a support pillow 40. Support pillow 40 is constructed of a sponge material or other porous material (such as a foamed rubber). The sponge material will preferably provide substantially the same type of support as described in connection with the support pillow of FIG. 1. Constructing the pillow 40 of a sponge material allows the support pillow to be placed in liquids, such as water. For example, the support pillow may be placed around the waist or torso of a person (particularly an infant or a small child) when bathing. The support pillow holds the person upright to prevent the person from falling or slipping while within the bathtub. This is particularly advantageous when attempting to bathe a small child, who may be slippery due to water or soap on the skin. After bathing, the support pillow may be removed from the person, wrung out, and left in the tub to dry.

Figure 3A:
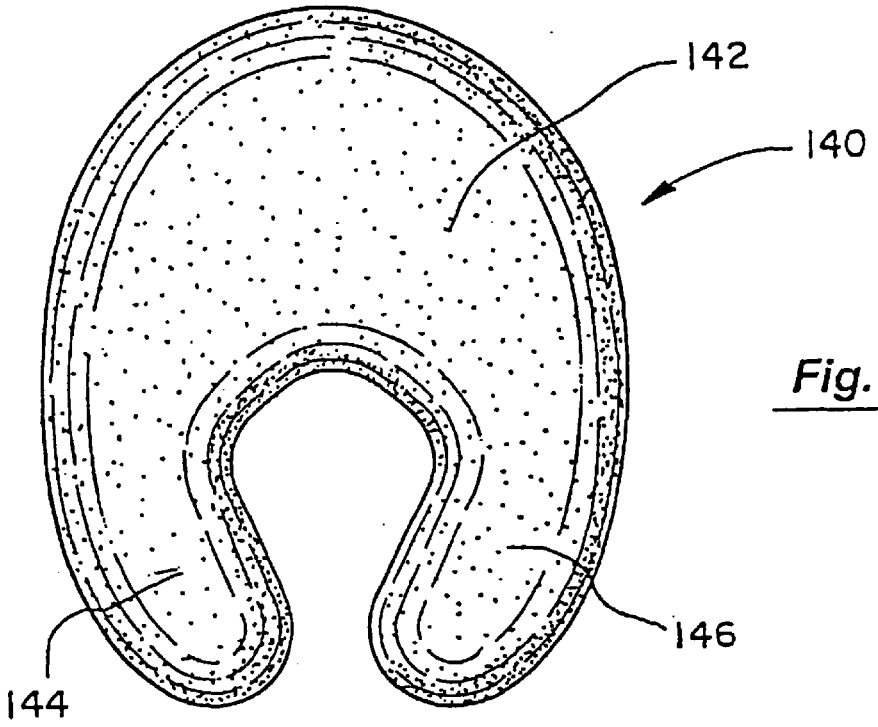
FIG. 3A is a top view of a further alternative embodiment of a support pillow according to the invention.
Figure 3B:
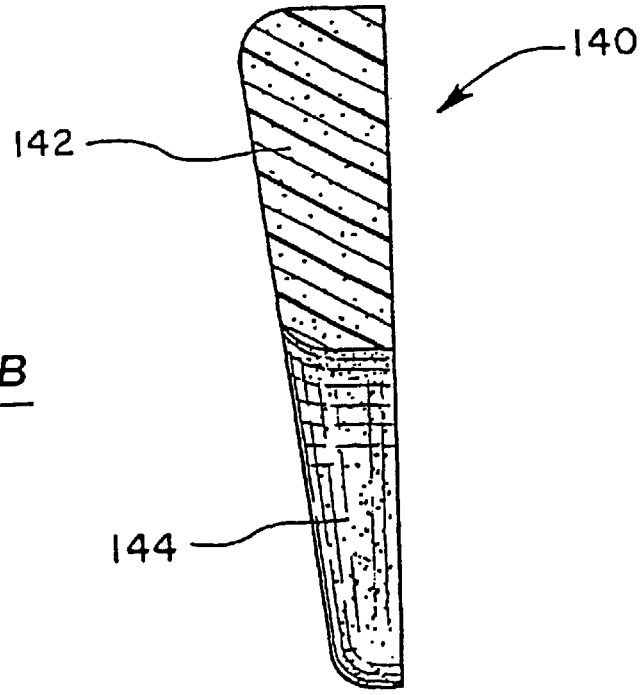
FIG. 3B is a cross-sectional side view of the support pillow of FIG. 3A.

Referring to FIGS. 3A and 3B, an alternative embodiment of a support pillow 140 which may be used in a liquid environment, such as when bathing, will be described. Support pillow 140 is preferably constructed of a sponge material, polyurethane foam or the like so that it may be used in water. Alternatively, support pillow 140 may be inflatable to its illustrated configuration. For example, the pillow may be constructed of a rubber or vinyl material which is inflated similar to pool toys.

Pillow 140 includes a medial region 142 and a pair of arms 144 and 146. As best shown in FIG. 3B, pillow 140 tapers from medial region 142 to arms 144 and 146. Also, arms 144 and 146 are spaced apart from each other. When configured in this manner, pillow 140 will preferably be used by placing the pillow on a bottom surface of a bath tub, large sink, or the like. A person is then placed on their back, with medial region 142 supporting the head. Pillow 142 will preferably have a height sufficient to keep the person's head from being covered by water when in such a position. With an infant or small child, arms 144 and 146 will tend to hold the person's torso stationary so that they will not roll off pillow 140. Optionally, pillow 140 could be placed around a person's waist similar to the other embodiments described herein. Also, a person could lay supine or sideways on the pillow.

Although the size of pillow 140 will vary depending on the size of the person using the pillow, some exemplary size ranges are as follows. Medial region 142 will preferably have a depth in the range from about 4 inches to about 15 inches, and more preferably about 9 inches. Arms 144 and 146 will preferably be spaced-apart by about 0.5 inch to about 6 inches, and more preferably at about 3 inches. Medial region 142 will preferably have an average thickness of about 2 to about 6 inches, and more preferably about 4 inches.

Figure 4:
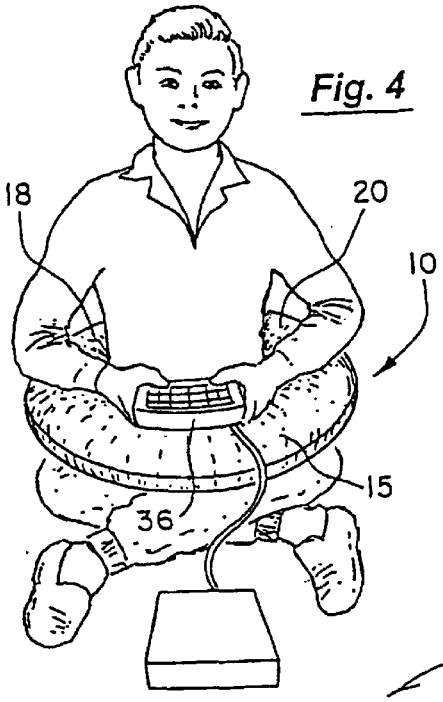
FIGS. 4 and 5 illustrate one exemplary use of the support pillow of FIG. 1 when placed around a person while in a sitting position.
Figure 5:
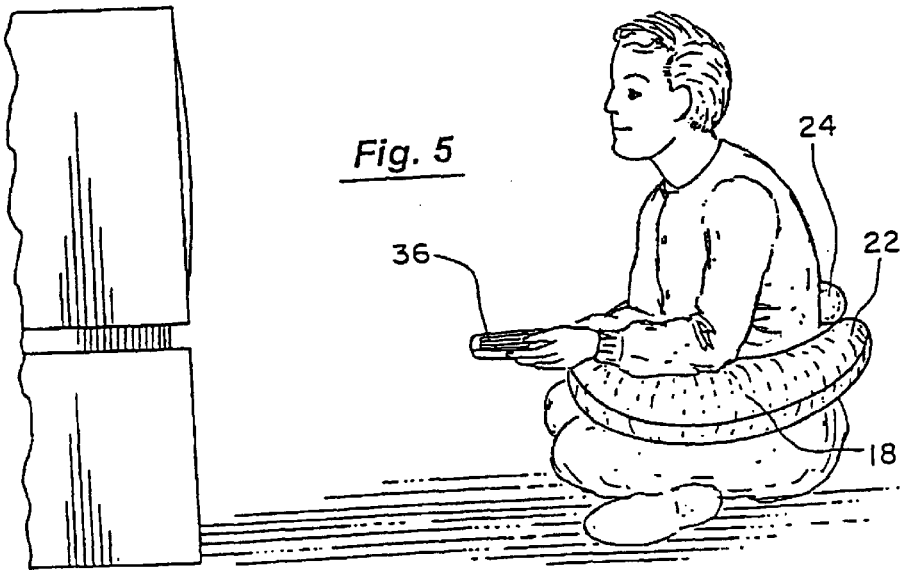

Referring now to FIGS. 4 and 5, an exemplary method for using the support pillow 10 will be described. In FIGS. 4 and 5, the support pillow 10 is placed around a person's torso with the medial region 15 being at the front of the person's torso. The cantilever arms 18, 20 extend around the side of the person's torso, with the ends 22, 24 being at the back of the person's torso. As previously described, the arms 18, 20 are resilient so that they may be moved away from each other. In this way, the pillow 10 may be positioned around the person's torso by grasping the arms 18, 20 and pulling them away from each other while sliding the ends 22, 24 around the person's torso. The arms 18, 20 are sufficiently biased so that the pillow 10 will remain vertically secured to the person's torso by the arms 18, 20. Preferably, the support pillow 10 will be positioned around the person's torso just above the waist, with the waist and the person's thighs helping to prevent the support pillow 10 from sliding down the person's waist when a force is applied to the top surface of the pillow 10.

In FIGS. 4 and 5, the person is in a sitting position, with the bottom of the support pillow 10 resting upon the person's knees and legs. In this configuration, the person may rest the elbows or forearms on the cantilever arms 18, 20 and/or the medial region 15 to support the person's arms while operating a keyboard 36, a computer game, an electronic device, or the like 36. When resting the elbows and/or the forearms on the support pillow 10, the support pillow 10 will experience only slight deformation so that sufficient support is provided to the person's arms while also providing a comfortable support surface. Optionally, the keyboard 36 itself may be directly rested on the support pillow 10, such as on the medial region 15 when operating the keyboard 36.

The support pillow 10 will preferably be constructed so that a single size may be used for most people. In some circumstances, however, it may be advantageous to vary the dimensions of the pillow 10 to fit the particular person.

Figure 6:
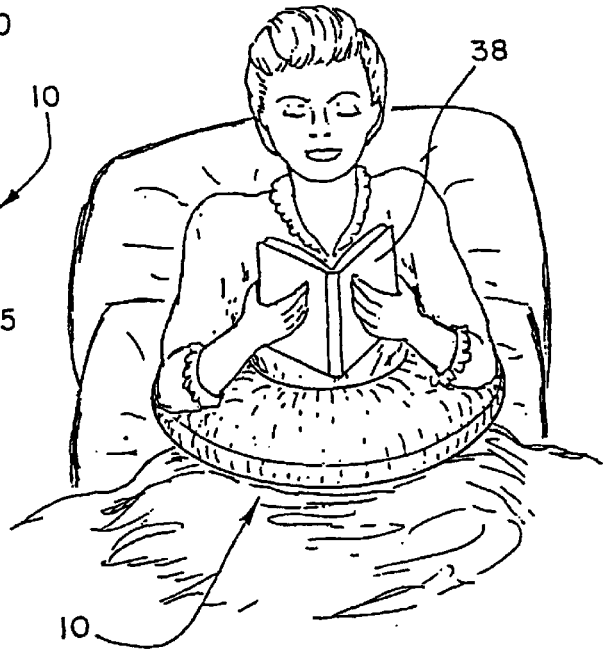
FIG. 6 illustrates a further exemplary method for using the support pillow of FIG. 1 to support an object in front of a person's torso according to the present invention.

Referring to FIG. 6, an alternative use of the support pillow 10 will be described. In FIG. 6, the support pillow 10 is placed around a person's torso in a manner similar as that previously described in FIGS. 4 and 5. The person will preferably be in a sitting position, with the support pillow 10 around the torso and being supported by the person's thighs. The person's elbows are rested on the support pillow at the cantilever arms 18, 20 or at the medial region 15 to provide support to the person's arms while reading a book 38 or other printed material. The vertical position of the support pillow 10 relative to the person's torso may be adjusted to place the book 30 at a comfortable reading position.

Figure 7:
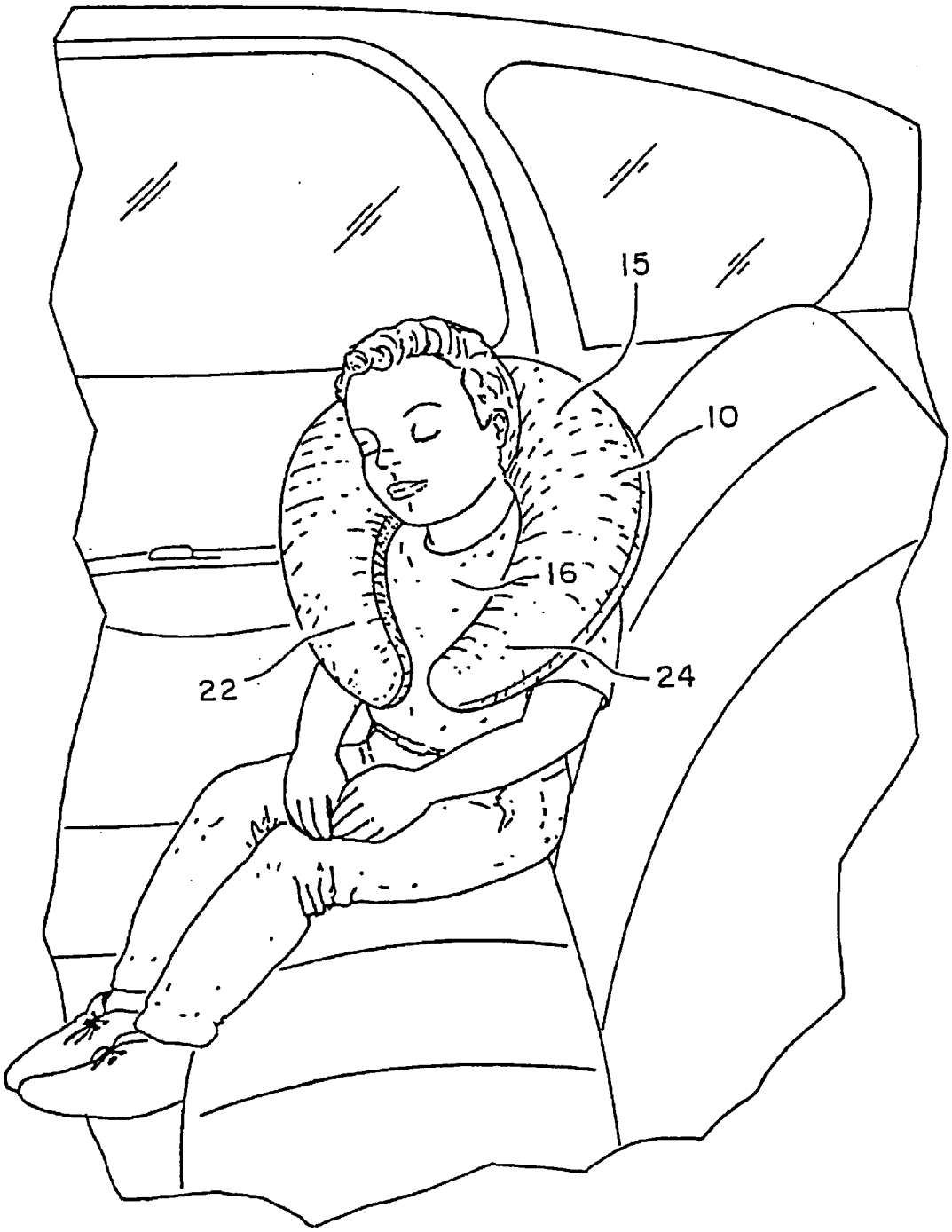
FIG. 7 illustrates yet another use of the support pillow of FIG. 1 for supporting a person's neck and head according to the present invention.

Referring to FIG. 7 still yet another exemplary use of the support pillow 10 will be described. In FIG. 7, the support pillow 10 is placed around a person's neck, with the medial region 15 being at the back of the person's head and the ends 22, 24 being in front of the person's neck. The well region 16 is sufficiently sized so that the support pillow 10 will not choke or interfere with the breathing of the person. The support pillow 10 is placed around the person's neck by pulling the ends 22, 24 away from each other and sliding the ends 22, 24 around the neck. When placed around the neck, the support pillow 10 rests upon the person's shoulders so that when the person's head is tilted, the person's neck or head will rest against the support pillow 10 in the region of the open well 16. The support pillow 10 may be used to support a person's neck or head when the person is in virtually any position, such as lying, sitting, or the like. When around the neck, the support pillow 10 is particularly useful when the person is sitting in a chair or other supporting member, such as when in an airplane or an automobile as shown in FIG. 7. When sitting in an upright position, it is often difficult to sleep comfortably since little support is provided to the head and neck. When the support pillow 10 is around a person's neck, the person may comfortably sleep in an upright position, with the support pillow 10 providing sufficient support to the neck and head.

Figure 8:
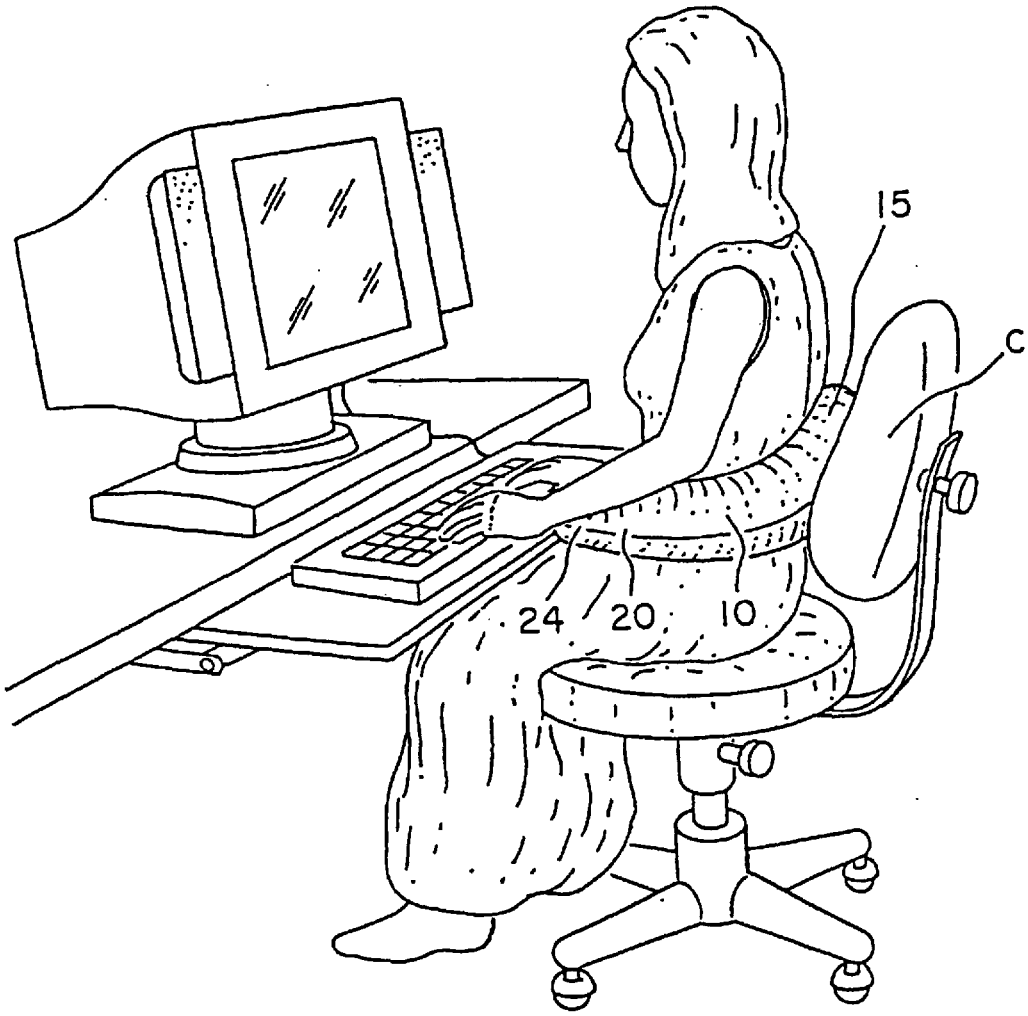
FIG. 8 illustrates still yet another use of the support pillow of FIG. 1 for supporting a person's lower back according to the present invention.

Referring to FIG. 8, still yet another exemplary method for using the support pillow 10 will be described. In FIG. 8, the support pillow 10 is placed around a person's torso with the medial region 15 being at the back of the person's torso, and the ends, 22, 24 being at the front of the person's torso. The medial region 15 will preferably be positioned in the area of the lower back, such as at the lumbar region, so that the support pillow may provide support to the person's lower back. The support pillow 10 is placed around the person's torso in a manner similar to that previously described in connection with FIGS. 4 and 5. The arms 18, 20 are sufficiently resilient so as to hold the support pillow in a constant vertical position relative to the person's torso.

The support pillow 10 may be used to provide support to the lower back when the person is in a variety of positions, such as when lying, sitting, and the like. The support pillow 10 will be particularly useful when sitting in a chair C with the outside surface 12 of the pillow being positioned against the back of the chair C. In this way, the inner surface 14 will be biased against the person's lower back. The support pillow 10 will undergo only slight elastic deformation when positioned against the person's back so that sufficient support will be provided to the lower back. At the same time, the support pillow 10 is sufficiently resilient so that the support will be comfortable to the person. A further advantage of support pillow 10 is that it will snugly fit around the person's torso so that when the person twists or moves about, the support pillow 10 will generally maintain its position about the person's torso. As shown in FIG. 8, arms 22, 24 are available to support the person's arms, such as when typing.

Figure 9:
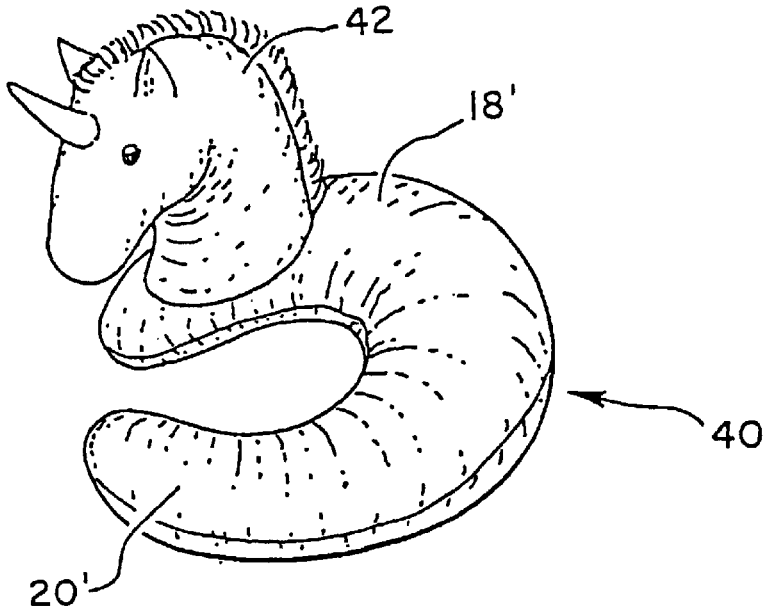
FIG. 9 illustrates an alternative embodiment of a support pillow having a head member attached to one of the cantilever arms according to the present invention.

Referring to FIG. 9, an alternative embodiment of a support pillow 40 will be described. The support pillow 40 may be constructed essentially identically to the support pillow of FIGS. 1–3 except that the support pillow 40 includes a head member 42 which is attached to one of the cantilever arms 18'. Alternatively, the head member 42 may be attached to the pillow 10 anywhere along the top surface, with the head member 42 preferably being generally parallel to a vertical axis of the support pillow 40. Although shown with the head of a unicorn, the head member 42 may include the head of virtually any animal or other figure. The head member 42 will preferably be filled with the same materials used to make the central core 30 of the support pillow 10. In this manner, the head member 42, will be soft and cushiony but will also be sufficiently rigid to be self-supporting. The support pillow 10 will also include a portion suitable for receiving a marking substance from a writing instrument as described in connection with FIG. 12.

Figure 10:
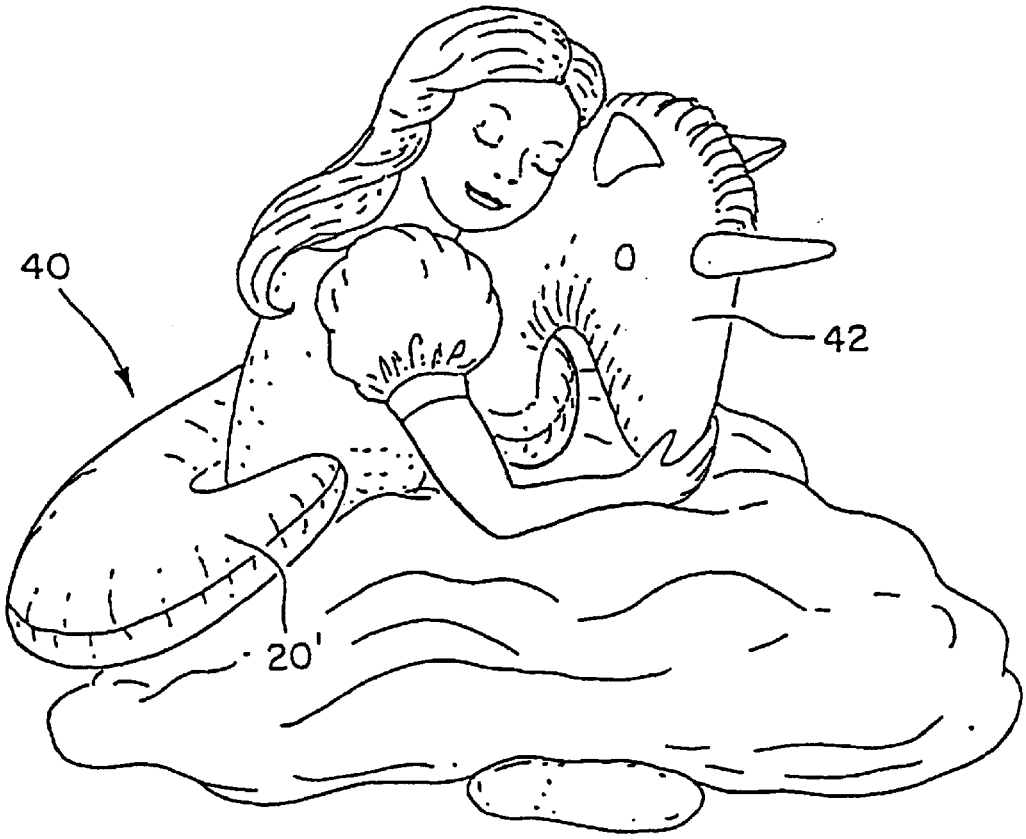
FIGS. 10 and 11 illustrate exemplary uses of the support pillow of FIG. 9.
Figure 11:
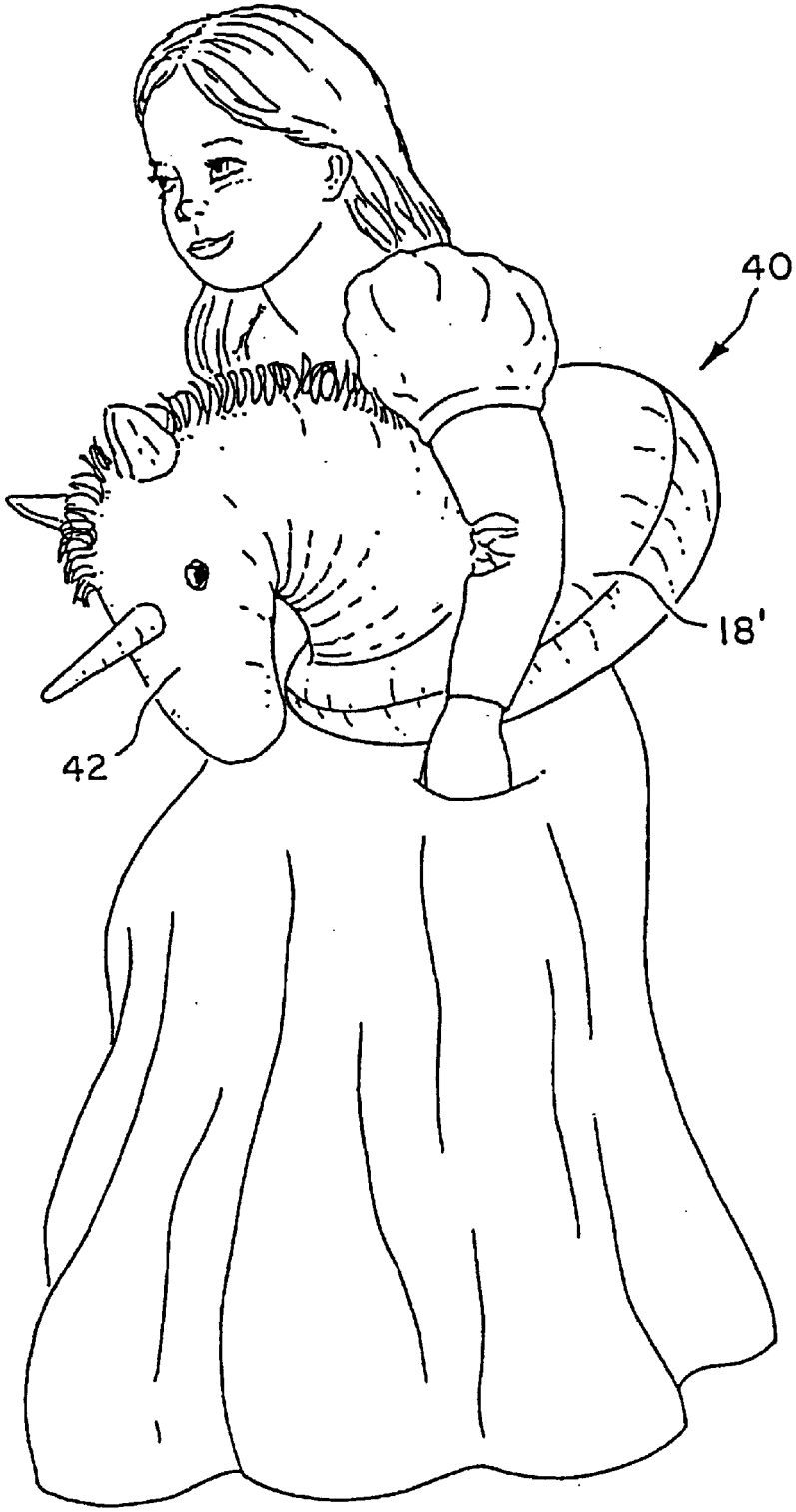

Referring now to FIGS. 10 and 11, exemplary uses of the support pillow 40 will be described. In FIG. 10, the support pillow 40 is placed around the person's torso with the cantilever arms 18', 20' being around the person's waist or lower torso, and with the head member 42 being in front of the person's torso. In this way the person may rest the head, neck, or chest on the head member when in a sitting position.

As illustrated in FIG. 11, the support pillow 40 may be placed around the person's torso when in the standing position. In this manner, the person may conveniently walk about with the support pillow 40 held around the torso, and with the head member 42 being at a comfortable viewing distance in front of the person. When the person sits, the support pillow 40 may be employed to rest his or her arms on the cantilever arms 18', 20'.

Referring to FIG. 12, a bottom portion 44 of the support pillow 40 is preferably constructed of a material which is suitable for receiving ink from a pen 46, marker, or similar writing instrument. Preferably, the bottom portion 44 will be constructed of a fabric having a smooth surface, such as satin, non-rip nylon, and the like. In this manner, the support pillow 40 may be used to receive autographs or other messages, such as when used at a slumber party, or to personalize the support pillow 40.

Referring to FIGS. 13 and 14, an exemplary device and method for storing and displaying a support pillow 50 will be described. Support pillow 50 includes a medial region 52 and two opposing arms 54 and 56, and may be constructed similar to the support pillows previously described herein. Surrounding medial region 52 is a central holder 58. Holder 58 preferably comprises a generally flexible material, such as cardboard, cardstock, plastic, and the like which is secured around medial region 52 to provide a convenient way to hold and display the support pillow 50. Preferably, holder 58 includes a tab 60 having an aperture 62 extending therethrough to enable the support pillow to be hung from a hanger 64 as shown in phantom line in FIG. 14.

Hence, by providing holder 58, support pillow 50 may be conveniently hung from a conventional hanger along an aisle of a retail store. Such a display is advantageous in that it reduces the amount of space required to store multiple support pillows. Further, by displaying the support pillow in this manner, purchasers are able to easily visualize the support pillow when passing down the aisle, therefore increases the chances for selling the pillow.

Upon removal from the hanger, a purchaser may simply remove holder 58, e.g., by tearing it from the support pillow, whereupon the support pillow 50 will be available for use. Optionally, a protective cover 66, such as a piece of clear plastic, may be provided over the support pillow 50 to protect the pillow from dirt and dust during storage. The protective cover 66 may simply be removed from pillow 50 prior to use.

Figure 15:
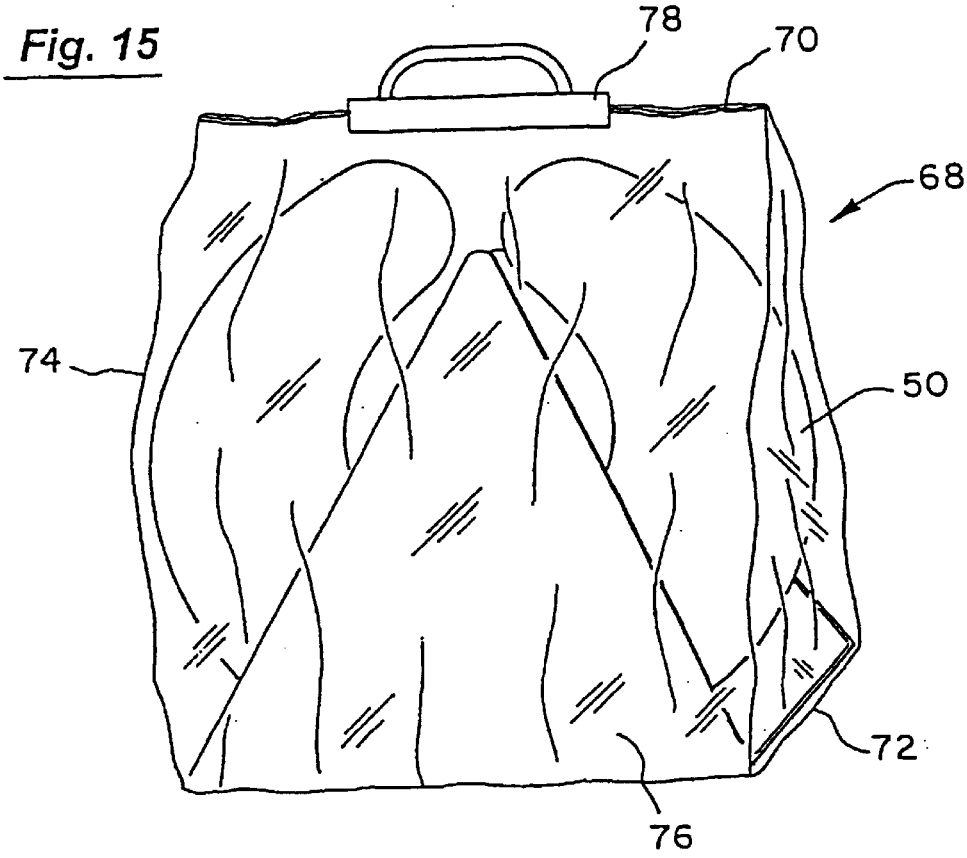
FIG. 15 is a front perspective view of a support pillow which is stored within a container according to the invention.

Referring now to FIG. 15, an exemplary container 68 for holding support pillow 50 will be described. Container 68 is constructed of a flexible material, such as a clear plastic, and has an open top end 70, a bottom end 72 and sides 74. Held within container 68 is a base member 76 which is preferably constructed of a rigid or semi-rigid material, such as cardboard or cardstock, which is folded so that it is flat on the bottom. In this way, when pillow 50 is placed in container 68, medial region 52 will rest on base member 76, which in turn will hold pillow 50 in a generally vertical orientation.

Conveniently, a snapable handle 78 is provided for carrying container 68. When snapped together, handle 78 also closes top end 70 to enclose pillow 50 within container 68. Hence, with such an arrangement, pillow 50 may conveniently be stored and displayed in a vertical orientation, while being able to be conveniently carried simply by grasping handle 78. To remove pillow 50 from container 68, handle 78 is separated and pillow 50 is lifted from container 68. Alternatively, other closing mechanism may also be used, such as a hook and loop fastener material, zippers, buttons and the like.

Figure 16:
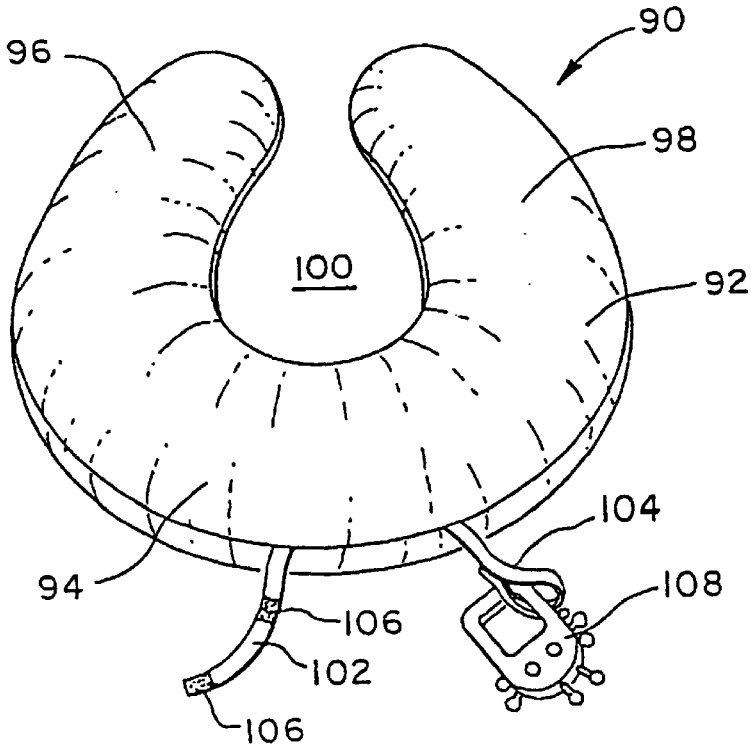
FIG. 16 is a top perspective view of a support pillow having a plurality of straps for attaching articles to the pillow according to the invention.

Referring now to FIG. 16, another exemplary embodiment of a support pillow 90 will be described. Support pillow 90 comprises a resilient cushion body 92 having a medial region 94 and two arms 96, 98 to define a generally open well 100. Support pillow 90 may be constructed similar to the other support pillows described herein.

Attached to medial region 94 are a pair of straps 102, 104, it being appreciated that other numbers of straps may be attached to the cushion body at other selective locations. Straps 102, 104 are preferably constructed of a strong, flexible material, such as cloth, nylon, and the like and may conveniently be sewn into the seam of the pillow body cover. As shown, each strap includes hook and loop fastener material 106, commonly sold under the trade name of Velcro (see strap 102). As best shown with strap 104, fastener material 106 allows strap 104 to be formed into a loop to hold a toy 108 to cushion body 98.

Although the fastener is shown as a hook and loop material, it will be appreciated that other attachment schemes may alternatively be provided. For example, toys could be attached by tying one or two straps around the toy. Alternatively, fasteners such as buckles, snaps, and the like could also be used with the straps.

In use, a child will preferably lay on the support pillow 90, with the stomach being generally over open well 100. The child's hands will then hang over medial region 94 so they are near straps 102 and 104. In this way, the toys held by the straps with always be within the child's reach. More specifically, the straps will prevent the child from pushing the toys out of reach during play and then becoming frustrated. In an alternative arrangement, the straps could be located at other areas on the pillow to allow the child to sit or lay in other orientations while playing with the toys. For example, the straps could be located on the arms to allow the child to lay across the arms or to sit in the well while playing with the toys.

Another advantage of the straps is that they allow for easy removal of the toys from the pillow. In this way, a variety of toys may be conveniently substituted so that the child will not become bored with the toys. Further, the toys may easily be removed for cleaning, repair or the like. The removable nature also allows the toys to be sold with the pillow as a system or a kit, or separately as replacement items.

Figure 17:
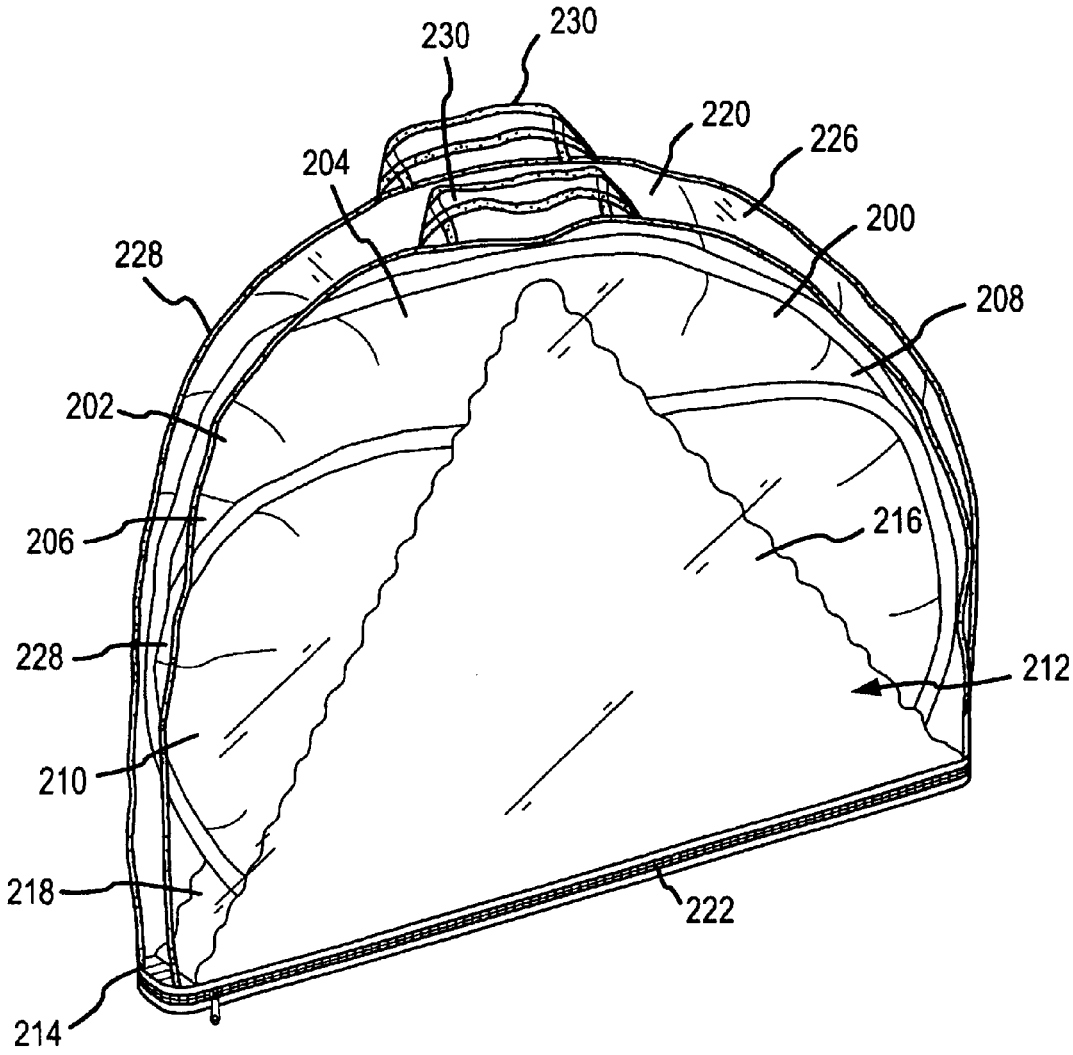
FIG. 17 is a front perspective view of a support pillow stored within a cover according to the invention.
Figure 18:
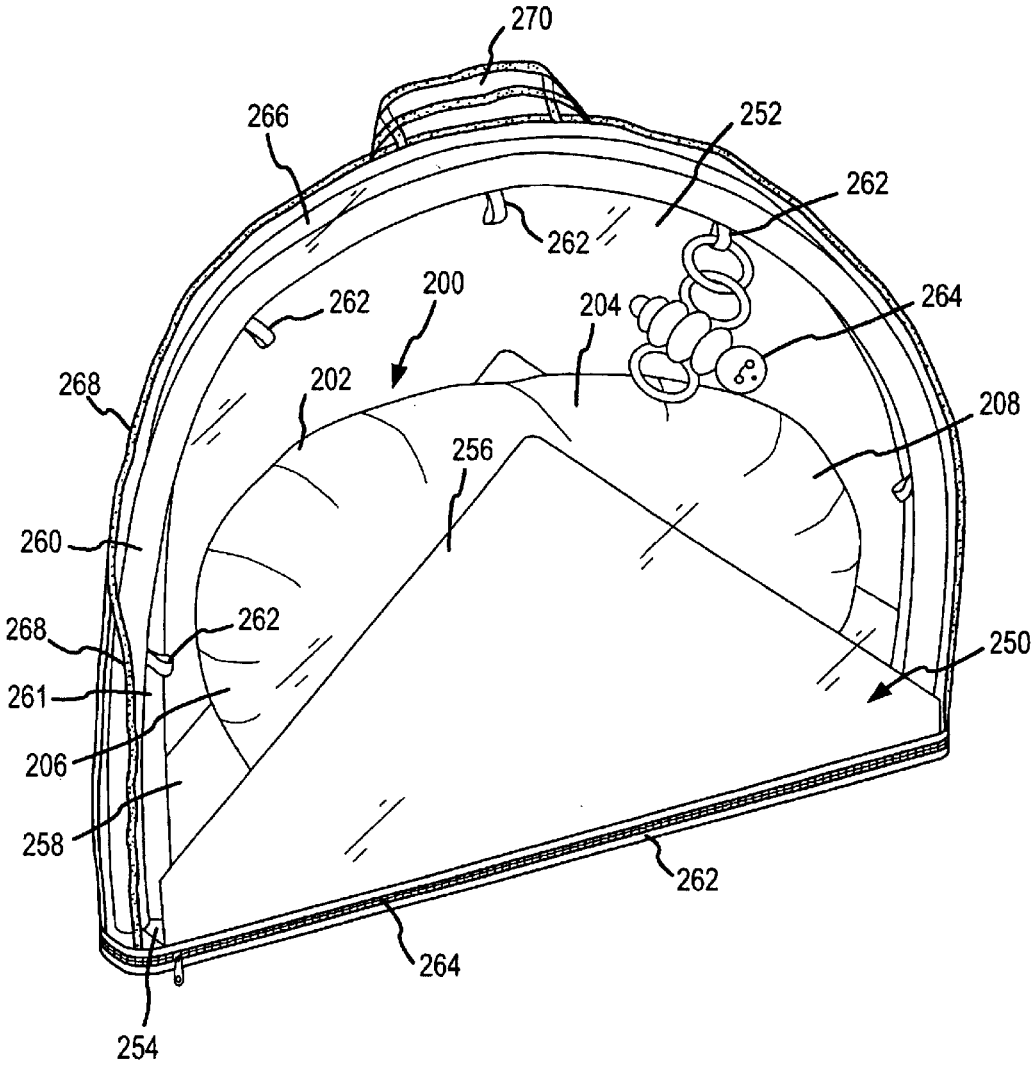
FIG. 18 is a front perspective view of a support pillow and toy bars that are stored within a cover according to the invention.
Figure 19:
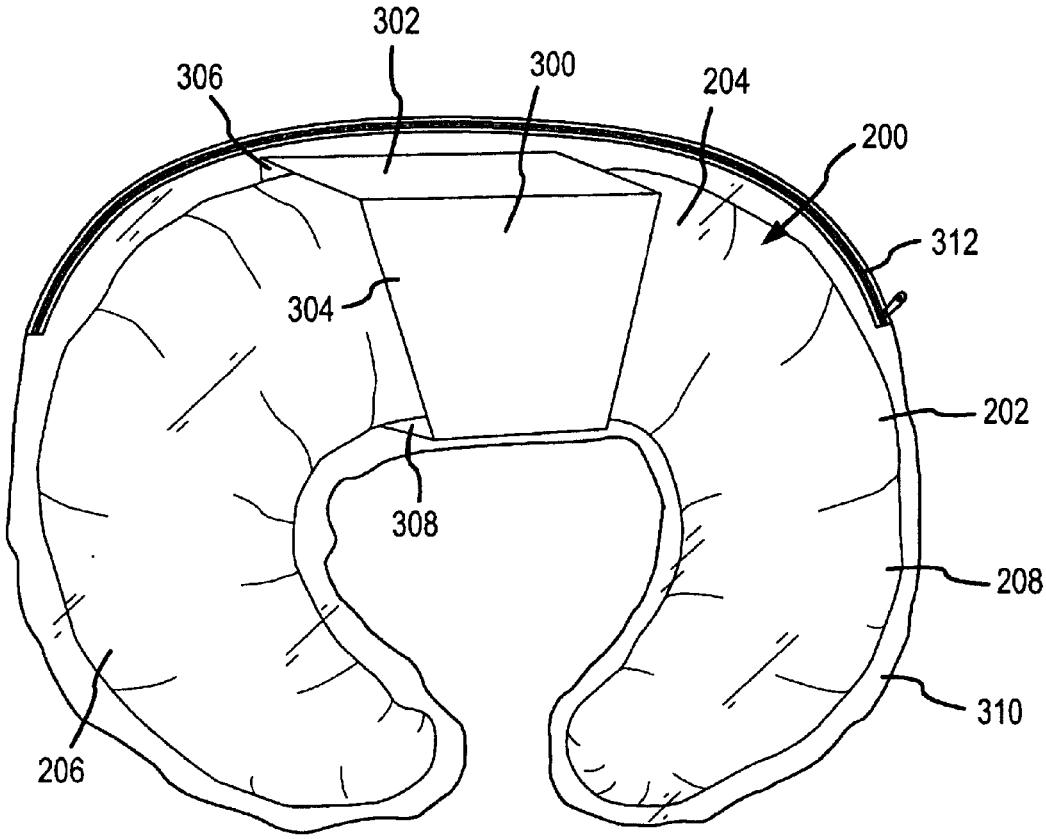
FIG. 19 is a top view of a support pillow that is stored within an alternative cover according to the invention.

FIGS. 17–19 illustrate various packaging schemes that may be used to hold various types of support pillows. Although shown with specific pillow configurations, it will be appreciated that the packaging schemes may be used with other pillow configurations as well. FIG. 17 illustrates a support pillow 200 comprising a pillow body 202 having a medial region 204 and a pair of opposing arms 206 and 208 that define a generally open well (hidden from view). As such, pillow 200 may be similar to any of the pillows described herein. Optionally, a pad 210 is coupled to pillow body 202. As shown in the storage position, pad 210 is folded against pillow body 202. In use, pad 210 is unfolded and extends away from arms 206 and 208 as well as extending across the well region so that a baby's lower body may lay or rest on pad 210 when using support pillow 200 in a manner similar to that described in U.S. Pat. No. 5,546,620, the disclosure of which is herein incorporated by reference. However, it will be appreciated that pillow 200 may not utilize pad 210.

Pillow 200 rests within a base member 212 having a bottom 214 and two spaced apart parallel walls 216 and 218. Pillow 200 sits between walls 216 and 218 and rests on bottom 214. Conveniently, either medial region 204 or arms 206 and 208 may rest on bottom 214. Base member 212 is constructed of a material with sufficient rigidity to hold pillow 200 in an upright orientation. Examples of materials that may be used include relatively thick paper, cardstock, plastics, cardboard and the like. As shown, walls 216 and 218 are triangular in geometry to provide sufficient support to hold pillow 200 while also permitting visualization of a significant portion of pillow 200. However, other shapes may also be used, such as arched, rectangular, waved, and the like. Optionally, the edges of walls 216 and 218 may be patterned. Walls 216 and 218 may be spaced apart approximately the same amount as the thickness of support pillow 200 to minimize storage space. For example, the walls may be spaced apart about 1 inch to about 10 inches, more preferably from about 2 inch to about 6 inches, and still more preferably from about 2.5 inches to about 5 inches.

Disposed about base member 212 is a cover 220 that may conveniently be transparent to provide visual access to pillow 200 and base member 212. Cover 220 includes a bottom end 222 that generally matches the shape of bottom 214 and includes a zipper 224 that is operated to provide access into the interior of cover 220. In this way, pillow 200 may easily be removed simply by operating zipper 224. Further, it will be appreciated that other fastening mechanisms may be used, such as snaps, a hook and loop fastener material, buttons and the like. Further, zipper 224 may be positioned at other locations on cover 220, such as at a top end 226.

Cover 220 is further configured to generally match or conform to the shape of the outer perimeter of pillow 200. As shown cover 220 may be form fitting or may be loosely disposed about pillow 200. In this way, the size of cover may be reduced to approximately the size of pillow 200. Cover 220 may be constructed of a transparent material, such as a plastic. Optionally, cover 220 may include edging 228 to provide reinforcement and handles 230 to facilitate carrying.

FIG. 18 illustrates an alternative packaging arrangement for a support pillow. For convenience of illustration, FIG. 18 will be described in connection with support pillow 200 (without pad 210). However, it will be appreciated that other types of support pillows may also be used. Pillow 200 is held within a base member 250 and a cover 252 that may be similar to those described in FIG. 17 except in size and shape.

Base member 250 has a bottom 254 and two spaced apart parallel walls 256 and 258. Pillow 200 sits between walls 256 and 258 and rests on bottom 254. Conveniently, either medial region 204 or arms 206 and 208 may rest on bottom 254. Base member 250 is constructed of a material with sufficient rigidity to hold pillow 200 in an upright orientation. Examples of materials that may be used include relatively thick paper, cardstock, plastics, cardboard and the like. As shown, walls 256 and 258 are triangular in geometry to provide sufficient support to hold pillow 200 while also permitting visualization of a significant portion of pillow 200. Conveniently, the pointed tips of walls 256 and 258 may be located someone along or just above medial region 204. It will be appreciated that other shapes may also be used, such as arched, rectangular, waved, and the like. Optionally, the edges of walls 256 and 258 may be patterned. Walls 256 and 258 may be spaced apart approximately the same amount as the thickness of support pillow 200 to minimize storage space.

Bottom 254 is longer than the width of pillow 200 in order to permit a set of bars 260 and 261 to rest on bottom 254. Bars 260 and 261 are covered and include a set of attachment mechanisms 262 to permit various toys 264 to be coupled to bars 260 and 261. In use, bars 260 and 261 are arranged over pillow 200 to permit toys 264 to hang above pillow 200. Such techniques are described generally in copending U.S. application Ser. Nos. 09/679,139, filed Oct. 3, 2000 and 09/802,097, filed Mar. 8, 2001, the disclosures of which are herein incorporated by reference. In storage, bars 260 and 261 are disposed about the outer perimeter of pillow 200 as shown in FIG. 18.

Disposed about base member 250 is cover 252 that may conveniently be transparent to provide visual access to pillow 200 and base member 250. Cover 252 includes a bottom end 262 that generally matches the shape of bottom 254 and includes a zipper 264 that is operated to provide access into the interior of cover 252. In this way, pillow 200 may easily be removed simply by operating zipper 264. Further, it will be appreciated that other fastening mechanisms may be used, such as snaps, a hook and loop fastener material, buttons and the like. Further, zipper 264 may be positioned at other locations on cover 252, such as at a top end 266.

Cover 252 is further configured to generally match or conform to the shape of bars 260 and 261. As shown, cover 252 may be form fitting or may be loosely disposed about bars 260 and 261. In this way, the size of cover may be reduced to approximately the size of bars 260 and 261 when disposed about pillow 200. Cover 252 may be constructed of a transparent material, such as a plastic. Optionally, cover 252 may include edging 268 to provide reinforcement and a handle 270 to facilitate carrying.

FIG. 19 illustrates support pillow 200 where medial region 204 is surrounded by a base member 300. Base member 300 includes a bottom 302, two walls 304 and 306 and a top 308. Walls 304 and 306 conveniently taper to permit top 308 to fit between arms 206 and 208. Base member 300 may conveniently be used to permit standing or stacking of pillow 200 as well as providing surfaces for including printed information.

Disposed about pillow 200 and base member 300 is a transparent cover 310. Cover 310 has essentially the same shape as pillow 200 but is slightly larger. Cover 310 includes a zipper 312 that defines an opening when opened to permit pillow 200 to be removed from cover 310. Zipper 312 is located adjacent medial region 204, although other locations may be used as well. Further, other types of fastening mechanisms may be used as previously described. Cover 310 may be constructed of a clear or transparent plastic to provide visual access to pillow 200 and base member 300.

In the packaging configurations of FIGS. 15 and 17–19, a variety of pillows having a variety of shapes and sizes may be used. For example, they may hold any of the pillows described or incorporated herein, as well as those described in U.S. Pat. Nos. 5,661,861; 6,038,720; 6,055,687; 6,119,873 and 5,546,620; and copending U.S. Pat. application Ser. Nos. 09/802,016, filed Mar. 8, 2001 (now U.S. Pat. No. 6434770), Ser. No. 09/799,759, filed Mar. 6, 2001, Ser. No. 09/662,935, filed Sep. 15, 2000 (now U.S. Pat. No. 6,321,403), Ser. No. 09/662,513, filed Sep. 14, 2000 (now U.S. Pat. No. 6.279.185), Ser. No. 09/679,139, filed Oct. 3, 2000, Ser. No. 09/802,097, filed Mar. 8, 2001, as well as covers for such support pillows as described in Ser. No. 09/802,310, filed Mar. 8, 2001 (now U.S. Pat. No. 6,453,493). The complete disclosures of all these references are herein incorporated by reference. Further various types of nursing pillows, U-shaped pillows, conventional pillows, decorative pillows and the like may be stored. The walls of the base member assist to hold these pillows in an upright orientation as well as providing a surface where various information may be printed. Such information may include, for example, product names and descriptions, marketing information, product use. information, and the like. The cover protects the pillow and, in some embodiments, may be configured to conform to the shape of the pillow, thereby reducing storage space. The transparent cover also provides visual access to the pillow. Further the cover permits easy access to the pillow through a large opening to facilitate its removal.

The pillows of the invention may also be packaged and stored using a variety of other packing devices, purses or the like. Examples of such packages and bags are described in references incorporated herein and in copending U.S. application Ser. No. 09/884,742, filed Jun. 18, 2001 (now U.S. Pat. No. 6640977) and Ser. No. 10/612265, filed July 1, 2003, incorporated herein by reference.

The invention further provides support pillows having an integral handle to facilitate movement, manipulation and/or transportation of the support pillow. The handles may be used with essentially any type or shape of support pillow. Merely by way of example, such handles may be used with the support pillows described in U.S. Pat. Nos. 5,261,134; 5,661,861; 6,038,720; 6,055,687; 6,119,873; and 5,546,620, previously incorporated by reference as well as the other references incorporated herein. However, the invention is not intended to be limited to only such support pillows.

The handles may be configured in a variety of shapes and sizes to facilitate easy grasping with a human hand. Merely by way of example, such handles may be configured as knobs, extensions, levers, and the like. In some cases, the handles may define an opening between the handle and the pillow body into which the user's hand may be inserted when grasping the handle. Further, the handles may be constructed of a wide variety of materials including rigid materials, resilient materials, flexible materials, fill materials fabrics, and the like. The handles may be coupled to the support pillows at a variety of locations, such as along a central axis, the center of mass, on the top, on the bottom, at an end, or the like. Further, the handles may be attached to the pillow body using a variety of attachment schemes, such as by sewing, glue, fasteners, such as snaps, and the like.

Figure 20:
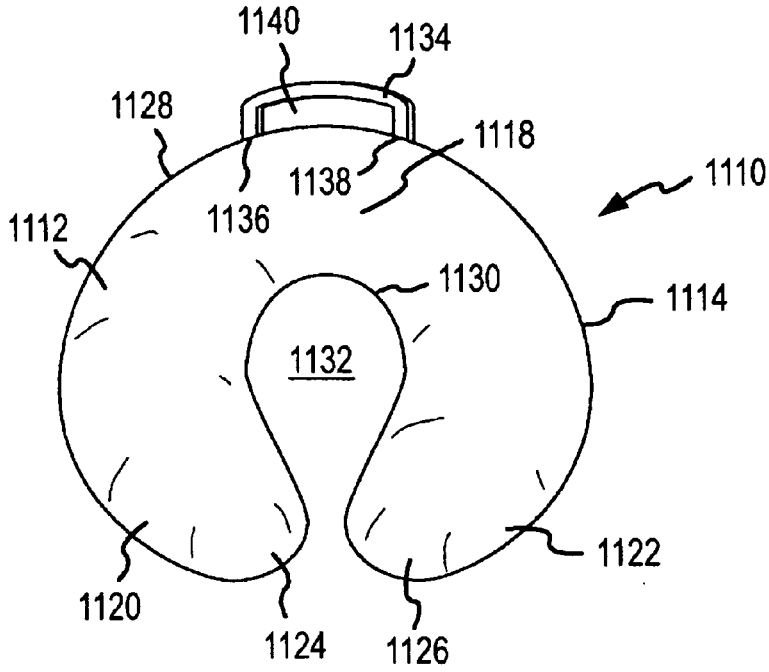
FIG. 20 is a top view of a support pillow having a handle according to the invention.
Figure 21:
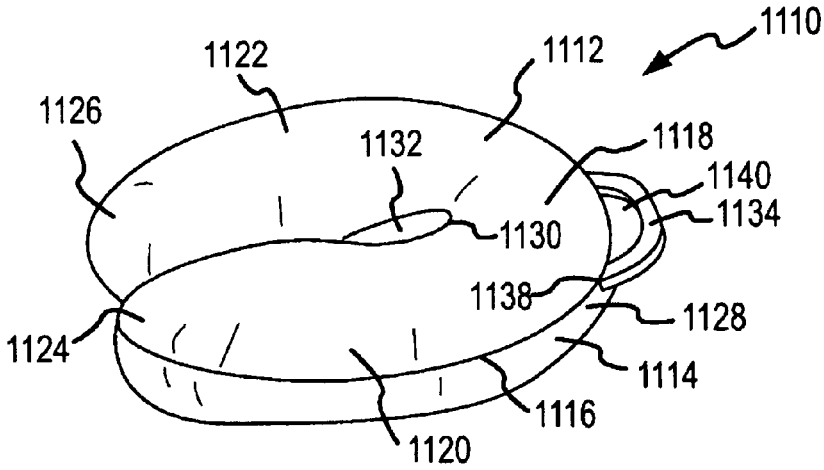
FIG. 21 is a perspective view of the support pillow of FIG. 20.

Referring now to FIGS. 20 and 21, one embodiment of a support pillow 1110 will be described. Pillow 1110 includes a resilient pillow body 1112 that may be constructed in shape and/or size and/or materials in a manner similar to the pillows described in U.S. Pat Nos. 5,261,134; 5,661,861; 6,038,720; 6,055,687; 6,119,873; and 5,546,620, previously incorporated by reference, as well as the other references incorporated herein. As shown, pillow body 1112 is covered with a fabric cover 1114 that is sewn together at a seam 1116. Pillow body 1112 includes a medial region 1118 and two opposing arms 1120 and 1122 that terminate in ends 1124 and 1126. Pillow body 1112 further has an outer periphery 1128 and an inner periphery 1130 that surrounds a generally open well 1132.

A handle 1134 is coupled to pillow body 1112 at medial region 1118. More specifically, handle 1134 includes a pair of ends 1136 and 1138 that are sewn to cover 1114 along seam 1116 to form an opening 1140. Conveniently, handle 1134 may be covered with the same fabric used for cover 1114. Further, handle 1134 may be rigid or include a fill material similar to that used with pillow body 1112.

Handle 1134 may be attached to a center of medial region 1118, with opening 1140 being large enough to receive a user's hand. For example, ends 1136 and 1138 may be about 3 inches to about 15 inches apart, and the distance between handle 1134 and medial region 1118 may be about 1 inch to about 4 inches.

In use, a user places a hand into opening 1140 and grasps handle 1134. While grasping handle 1134, pillow 1110 may be moved, manipulated or lifted off of a support surface. During transport, arms 1120 and 1122 will typically hang below handle 1134 in a vertical orientation. By placing handle 1134 at the center of medial region 1118, pillow 1110 is balanced when grasped and lifted to facilitate its transport.

The handles associated with any of the pillows described herein may take a variety of forms and be used in a variety of applications. For example, one or more handles may be used to adjust the orientation of the pillow when placed about the user. Such handles may be placed at various locations on the pillow body, such as on the top surface or the sides to facilitate easy grasping. Once particular type of handle is a tab or flap that may extend from the cover. In this way, the user may easily grasp the tab or flap and reorient the pillow body.

Figure 22:
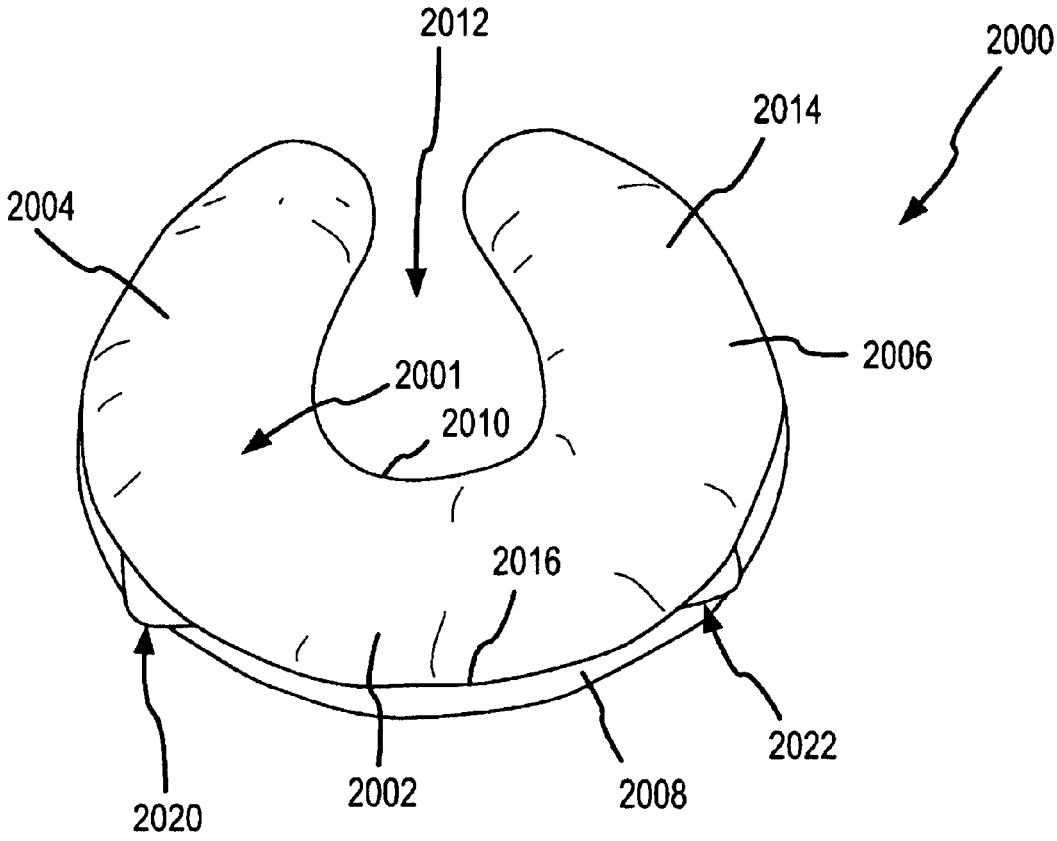
FIG. 22 is a perspective view of an alternative support pillow having a pair of flaps according to the invention.

One example of a pillow 2000 constructed in such a manner is illustrated in FIG. 22. Pillow 2000 may be constructed in a manner similar to any of the other pillows described or incorporated herein by reference and includes a pillow body 2001 having a medial region 2002 and two opposing arms 2004 and 2006. Pillow body 2001 also includes an outer periphery 2008 and an inner periphery 2010 that defines a generally open well region 2012. Pillow body 2001 may conveniently be constructed of a cover 2014 that encompasses a fill material similar to other embodiments described herein. Cover 2014 may be constructed from two pieces of fabric that are sewn together along a seam line 2016.

Coupled to pillow body 2001 are a pair of fabric flaps 2020 and 2022. These flaps may be constructed using the same type of fabric or a different type of fabric used to construct cover 2014. Conveniently, flaps 2020 and 2022 may be sewn to cover 2014 along seam line 2016. However, other ways may also be used, such as by use of glue, snaps, buttons, a hook and loop fabric material and the like. In some cases, the flaps may even be an integral part of cover 2014, or part of a removable cover similar to other embodiments described or incorporated herein. The flaps may also be constructed of other types of materials. For example, the flaps could be constructed of plastic, rubber or the like, and could be either flexible or rigid.

In this embodiment, flaps 2020 and 2022 are coupled to pillow body near where ends 2004 and 2006 meet medial region 2002. Flaps 2020 and 2022 may be spaced apart by a distance in the range from about 12 inches to about 20 inches, and more preferably at about 16 inches. However, it will be appreciated that the flaps may be spaced at different distances and locations as well. For example, a single flap could be placed at medial region 2002. Further, pillow 2000 may include a single flap or more than two flaps.

Flaps 2020 and 2022 may extend outward from pillow body 2001 by a distance in the range from about 1 inch to about 6 inches and may have a similar width. As shown, the flaps are generally rounded, although other shapes could be used as well. For example, the flaps could be square, triangular, circular, oval and the like, and may have one or more openings to facilitate grasping.

Pillow 2000 may be worn or used using any of the techniques or methods described herein or in any of the references incorporated herein. If the pillow needs to be positioned or repositioned, one or more of the flaps may be grasped by the user (or a bystander) and used to manipulate the position of the pillow. For example, if the user is sitting down, with the pillow being positioned about the user's waist, the user may reach forward and grasp one of the flaps. The pillow may then be rotated about the user's waist to the desired position. In this way, the user may remain seated while being able to easily manipulate the orientation of the pillow. This could even be done while a baby or other object is resting on the pillow. Further, this permits the pillow to be manipulated using only a single hand. This technique may be used to position the pillow when in other orientations as well. In addition to manipulating the orientation of the pillow, the flaps may also be used as a handle to carry the pillow, to move the pillow up and down, side to side, or the like.

The present invention has been described in detail. However, modifications and variations may occur to those skilled in the art without departing from the principles of the claimed invention. Therefore, the scope of the invention should be determined primarily with reference to the appended claims, along with a full scope of equivalents to which those claims are entitled by law.

What is claimed is:

1. A support pillow comprising:

a pillow body having a medial region defining a center of the pillow body and two opposing arms that define an outer periphery and an inner periphery, wherein the inner periphery defines a generally open well;

at least one flap coupled to the pillow body at the outer periphery to adjust the position of the pillow when worn about a user, wherein the flap is coupled to the pillow body at a single location that is laterally offset from the center of the pillow body to facilitate easy grasping of the flap when the medial region is at the user's front side, said at least one flap not being coupled to any other flap.

2. A pillow as in claim 1, wherein the flap comprises a piece of fabric that is coupled to the pillow body.

3. A pillow as in claim 1, wherein the pillow body comprises a fill material that is encased in a fabric cover, and wherein the flap is coupled to the fabric cover.

4. A pillow as in claim 3, wherein the fabric cover comprises a top piece and a bottom piece that are sewn together along a seam line, and wherein the flap is sewn between the top piece and the bottom piece.

5. A pillow as in claim 1, wherein the flap comprises a first flap and further comprising a second flap coupled to the pillow body at the outer periphery.

6. A pillow as in claim 5, wherein the flaps are coupled to the pillow body near, where the two arms meet the medial region.

7. A pillow as in claim 6, wherein the flaps are positioned about 12 inches to about 20 inches apart.

8. A pillow as in claim 1, wherein the flap extends from the pillow body by a distance in the range from about 1 inch to about 6 inches.

9. A pillow as in claim 1, wherein the arms and the medial region are generally curved to provide a curved exterior periphery.

10. A method for positioning a pillow about a person, the method comprising:

providing a pillow comprising a pillow body having a medial region defining a center of the pillow body and two opposing arms that define an outer periphery and an inner periphery, wherein the inner periphery defines a generally open well; and at least one flap coupled to the pillow body at the outer periphery to adjust the position of the pillow when worn about a user wherein the flap is coupled to the pillow body at a single location that is laterally offset from the center of the pillow body to facilitate easy grasping of the flap when the medial region is at the user's front side, said at least one flap not being coupled to any other flaps.

placing the pillow about a person's torso; and grasping the flap and manipulating the pillow body to a desired orientation about the person's torso.

11. A method as in claim 10, wherein the flap comprises a piece of fabric that is coupled to the pillow body, and wherein the piece of fabric is grasped in the person's hand.

12. A method as in claim 10, wherein the pillow body comprises a fill material that is encased in a fabric cover, and wherein the flap is coupled to the fabric cover.

13. A method as in claim 12, wherein the fabric cover comprises of top piece and bottom piece that are sewn together along a seam line, and wherein the flap is sewn between the top piece and the bottom piece.

14. A method as in claim 13, wherein the flap is generally rounded.

15. A method as in claim 10, wherein the flap comprises a first flap and further comprising a second flap coupled to the pillow body at the outer periphery, and wherein the first flap or the second flap is grasped.

16. A method as in claim 15, wherein the flaps are coupled to the pillow body near where the two arms meet the medial region, and wherein the flaps may be coupled with each hand.

17. A method as in claim 16, wherein the flaps are positioned about 12 inches to about 20 inches apart.

18. A method as in claim 10, wherein the flap extends from the pillow body by a distance in the range from about 1 inch to about 6 inches.

19. A method as in claim 10, wherein the arms and the medial region are generally curved to provide a curved exterior periphery.

20. A support pillow comprising:

a pillow body having a medial region and two opposing arms that define an outer periphery and an inner periphery, wherein the inner periphery defines a generally open well;

a pair of separate and unconnected flaps coupled to the pillow body at the outer periphery to adjust the position of the pillow when worn about a user, wherein the flaps are disposed near where the two arms meet the medial region, and wherein the flaps are positioned about 12 inches to about 20 inches apart.

* * * * *